US005552813A

United States Patent [19]

Takada et al.

[11] Patent Number: 5,552,813

[45] Date of Patent: Sep. 3, 1996

[54] INK JET HEAD WITH NOZZLE ARRANGEMENT TO REDUCE VISCOUS DRAG

[75] Inventors: Shinsaku Takada; Hisayoshi Fujimoto; Nobuhisa Ishida; Yasushi Ema; Toshio Amano; Akihiro Shimokata, all of Kyoto, Japan

[73] Assignee: Rohm Co., Ltd., Kyoto, Japan

[21] Appl. No.: 26,550

[22] Filed: Mar. 4, 1993

[30] Foreign Application Priority Data

| | | | |
|---|---|---|---|
| Mar. 11, 1992 | [JP] | Japan | 4-052844 |
| Aug. 27, 1992 | [JP] | Japan | 4-228528 |
| Sep. 10, 1992 | [JP] | Japan | 4-241766 |

[51] Int. Cl.[6] ..... B41J 2/045

[52] U.S. Cl. ..... 347/40; 347/70; 347/94

[58] Field of Search ..... 347/40, 43, 47, 347/70, 71, 94, 68

[56] References Cited

U.S. PATENT DOCUMENTS

| | | | |
|---|---|---|---|
| 4,312,008 | 1/1982 | Taub et al. | 347/71 |
| 4,521,788 | 6/1985 | Kimura et al. | 347/40 X |
| 4,774,529 | 9/1988 | Paranjpe et al. | 347/43 X |
| 5,072,240 | 12/1991 | Miyazawa et al. | 347/40 X |
| 5,157,420 | 10/1992 | Naka et al. | 347/40 |

FOREIGN PATENT DOCUMENTS

| | | | |
|---|---|---|---|
| 54-123954 | 9/1979 | Japan . | |
| 55-137976 | 10/1980 | Japan . | |
| 56-000172 | 1/1981 | Japan . | |
| 56-148568 | 11/1981 | Japan . | |
| 56-155771 | 12/1981 | Japan . | |
| 57-182452 | 11/1982 | Japan | 347/71 |
| 58-108163 | 6/1983 | Japan | 347/71 |
| 2-266944 | 10/1990 | Japan . | |
| 3-32847 | 2/1991 | Japan | 347/68 |
| 4-156332 | 5/1992 | Japan | 347/40 |

*Primary Examiner*—Benjamin R. Fuller
*Assistant Examiner*—Alrick Bobb
*Attorney, Agent, or Firm*—Wolf, Greenfield & Sacks, P.C.

[57] ABSTRACT

A nozzle arrangement structure in an ink jet print head. A plurality of pressure chambers are arranged in circular form, and a plurality of nozzles receive an ink supply from the corresponding pressure chambers and are arranged in an zig zag arrangement to obtain a small interval between the dots. Two straight lines concerning the zig zag arrangement are inclined against a printing direction and a direction perpendicular to the printing direction. When an ink discharge from the nozzles is controlled, preprocessing of serial data is carried out by hardware.

16 Claims, 27 Drawing Sheets

INK JET HEAD WITH NOZZLE ARRANGEMENT TO REDUCE VISCOUS DRAG

BACKGROUND OF THE INVENTION i) Field of the Invention

The present invention relates to an ink jet print head for use in a non-impact printer, and more particularly to its nozzle arrangement structure and also to a head driver circuit for the ink jet print head on the premise of the nozzle arrangement structure.

ii) Description of the Related Arts

Conventionally a non-impact printer using an ink jet print head has been known. The non-impact printer can be widely used for a facsimile machine, a plotter, a bar code printer, a digital copying machine and the like. The non-impact printer is provided with a head having a number of fine nozzles, and by blowing fine particles of an ink onto printing medium such as paper or the like from the nozzles, printing is carried out without contacting the head with the printing medium.

In an impact printer for performing printing by contacting a head with a printing medium, when the head is designed, it is necessary to consider a material of the printing medium, and also, when the head is produced, it is required to sufficiently consider the same. The non-impact printer has an advantage that such a technical limitation does not exist. Further, high speed printing is possible by using the non-impact printer.

In FIG. 32, there is shown a conventional ink jet print head. This ink jet print head 10 has a similar construction to one disclosed in Japanese Patent Laid-Open No. Hei 2-266944.

The ink jet print head 10 possesses a flat plate structure. This flat plate structure can be formed by etching a glass plate or the like. The ink jet print head 10 is comprised of an ink chamber 12, a plurality of pressure chambers 14, a plurality of ink slits 16 and a plurality of nozzles 18. The ink chamber 12 is formed in circular shape near the peripheral part of a circular glass plate. The pressure chambers 14 are formed inside the circle. The pressure chambers 14 are formed corresponding to the respective nozzles 18. The ink slits 16 couple the pressure chambers 14 with the corresponding nozzles 18. The nozzles 18 are arranged in a rhombic form near the center of the ink jet print head 10, as shown by a one-dotted line in FIG. 32. In fact, the fine nozzles 18 are arranged on this rhombic form in high density, but this is omitted for brevity in FIG. 32.

In the ink jet print head 10, as a member to be overlapped on this flat plate structure, a pressure generating part 20 is used. The pressure generating part 20, for example, is composed of a piezoelectric substrate or the like, and on this pressure generating part 20, a plurality of electrodes 22 are formed. Each electrode 22 is provided corresponding to each pressure chamber 14 so as to construct a single piezoelectric element. Hence, when an electric signal is applied to one electrode 22, the piezoelectric element of this electrode 22 is excited, and the pressure is added to the corresponding pressure chamber 14. Then, the ink in the pressure chamber 14 is caused to flow in the direction to the nozzle 18 via the ink slit 16. As a result, the ink is discharged from the corresponding nozzle 18. In this case, the plurality of electrodes 22 can not be seen in the state that the pressure generating part 20 is partly cut out, as shown in FIG. 32, but the row of the plurality of electrodes 22 is shown by two broken lines for understanding.

In the ink jet print head, the viscous drag of the ink flowing in the ink slit depends on the length of the ink slit. In this conventional example, since the pressure chambers 14 are arranged in the circular form, the lengths of the ink slits 16 become almost equal. Hence, in the conventional example, the viscous drags of the ink slits 16 are equalized to obtain effects such as a realization of high frequency driving and the like.

However, when the pressure chambers 14 are arranged in the circular form as described above, since the nozzles 18 are concentrated upon the central part of the circle, it is difficult to perform multi-dot printing. The dot is a printing part formed by the ink discharged once from one nozzle. In the conventional example shown in FIG. 32, since the interval between the adjacent nozzles 18 is restricted by the interval between the ink slits 16, the interval between the nozzles 18 becomes large, and as a result, the dot interval becomes large.

SUMMARY OF THE INVENTION

It is the first object of the present invention to make the dot density high and thus to make possible clear and fine printing.

It is the second object of the present invention to reduce the viscous drag of the ink without increasing the difficulty of manufacturing and thus to realize high speed printing with high accuracy.

It is the third object of the present invention not to necessitate preprocessing such as an order operation and the like on driving data when an ink jet print head improved by the present invention is driven.

An ink jet print head of the present invention comprises:

a) a plurality of nozzles arranged in a zig zag arrangement on a flat surface for discharging ink; and b) discharge means for causing the discharge of the ink from the nozzles.

It will be readily understood that the main improvement of the present invention is in the arrangement of the nozzles. At the same time, it would be incorrect to consider that this improvement is only a design choice or an obvious modification for those skilled in the art or the like. First, though the above-described subject, that is, a high density arrangement of the nozzles has been widely recognized for those skilled in the art, an effective and readily practicable solving method has not heretofore been known. The present invention is completed in consideration of some already proposed improved constructions and under sufficient and careful consideration, and this proposal is by no means an obvious modification for those skilled in the art. Second, the arrangement of the nozzles of the main improvement of the present invention requires remarkable regularity, and from this viewpoint the present invention is by no means the proposal of the obvious modification for those skilled in the art.

The zig zag arrangement is an arrangement satisfying the following two conditions. That is, first, the nozzles are arranged on first and second straight lines positioned on the flat surface. Second, the nozzles arranged on the first straight line are offset with respect to the nozzles arranged on the second straight line along a direction perpendicular to a printing direction.

The first advantage of the zig zag arrangement is that while the interval between the adjacent nozzles is determined to be relatively large, the dot density can be increased, and thus the printing quality can be improved.

In the case of a conventional rhombic arrangement, the nozzles on each edge of the rhombus are arranged on one straight line, and ink paths corresponding to the nozzles are formed in one side of the straight line (outside the thombus). Hence, it is required that the interval between the adjacent nozzles is at least the sum of the width of the ink path and the thickness of the partition wall between the ink paths.

On the other hand, in the zig zag arrangement of the present invention, the nozzles are arranged on the first and second straight lines separated from each other. Hence, the above-described interval restriction (at least the sum of the width of the ink path and the thickness of the partition wall between the ink paths) applies for every straight line. If the adjacent two nozzles are arranged on different straight lines, such an interval restriction does not apply, and an extremely loose interval restriction such as at least the thickness of the partition wall between the nozzles applies instead.

In the present invention, first, since the nozzles are arranged on the separated two straight lines, the ink paths are not drawn out to one side of the nozzle arrangement, and the ink paths can be alternately drawn out to both sides of the nozzle arrangement. Second, since the nozzles arranged on the first straight line are offset with respect to the nozzles arranged on the second straight line along the direction perpendicular to the printing direction, the adjacent nozzles are not arranged on the same straight line but on the different straight lines. In other words, the adjacent nozzles adjoin each other slantingly against the two straight lines.

In this manner, according to the present invention, while the interval between thee nozzles is actually kept relatively large, the interval between the nozzles can be reduced. Thus, the aforementioned first advantage can be obtained.

The second advantage of the zig zag arrangement, that is, the reduction of the viscous drag of the ink is generated on the basis of the first advantage. For example, since the interval restriction of the nozzles is extremely loose, the ink inlet dimension of the nozzles can be enlarged, and the cross section of the ink paths corresponding to the nozzles can also be enlarged. This all lead to a reduction of the viscous drag.

For example, when the internal shape of the nozzles is formed to a tapered shape tapering from the ink inlet side to the ink outlet side, the tapered angle can be enlarged compared with a conventional nozzle. This shows that the ink outlet dimension is not changed or the same as is conventional, but the ink inlet dimension can be enlarged. In one embodiment described hereinafter, it is described that this angle is at least 4° against the ink discharge direction, and the ink inlet dimension/the ink outlet dimension is at least 2.5. Attention should be paid to this fact. However, of course, the present invention is not restricted to this angle.

Also, for example, when the internal shape of the nozzles is formed to a stepwise shape, that is, the diameter size is stepwise changed, the ink outlet dimension is the same as conventional, and the ink inlet dimension can be enlarged. For instance, the ink inlet dimension can be at least 3 times of the ink outlet dimension.

Further, the depth of the ink paths can be enlarged more than its width, within the limit of thickness of glass, at least near the nozzles by using anisotropic etching. By this, the cross section of the ink path can be enlarged. This means, at the same time, that the viscous drug of the ink path can be further reduced, and the interval between the ink paths can be reduced. On the other hand, the above-described first advantage of loosening the restriction of intervals of ink paths also allows loosening of the restriction of widths of ink paths. That is, the setting of the depth of the ink path, along with the above-described first advantage, makes the dot density large.

The third advantage of the zig zag arrangement, that is, the equalization of the viscous drag is also produced on the basis of the first advantage. As described above, there is caused room for enlarging the width of the ink path, and this, at the same time, make possible a design so as to remove the viscous drag difference between the ink paths corresponding to the nozzles.

More specifically, by relatively diminishing the cross section of the ink slits concerning the nozzles arranged in relatively end portions of the first and second straight lines, and by relatively enlarging the cross section of the ink slits concerning the nozzles arranged near the central portions of the first and second straight lines, the viscous drags of the ink slits can be equalized.

This advantage becomes remarkable when the nozzles are arranged so as to concentrate at the portion near the central point of a circle or a circular arc and further the ink paths are formed so as to draw an almost radial pattern from this central portion. That is, although such a radial construction itself is already known, by combining with the zig zag arrangement of the present invention, the above-described third advantage can be made more remarkable.

The fourth advantage of the zig zag arrangement is that the driving force of the nozzles can be reduced. This is based on the above-described second advantage. That is, when the viscous drag is reduced, it is possible to reduce the energy (driving force of the nozzles) required for supplying the ink to the ink paths.

The discharge means for discharging the ink by driving the nozzles, for example, can be constructed by using piezoelectric elements. Each of the piezoelectric elements is excited and caused to distort by a command supplied as a voltage. When the piezoelectric element is used as the discharge means, it is preferable to use a diaphragm member vibrated by the distortion of the piezoelectric element. When the viscous drag is reduced in the zig zag arrangement, as described above, since the voltage for driving the piezoelectric element can be lowered, the damping oscillation becomes quick to improve the response of the ink discharge operation. This enables high speed printing.

The ink jet print head of the present invention can be constructed as a flat plate structure. This flat plate structure includes:

a) a substrate;

b) a plurality of nozzles arranged in a zig zag arrangement on the surface of the substrate as the flat surface; and c) path means formed on the substrate for supplying the ink to the nozzles.

The path means is means corresponding to the above-described ink path. This, for example, can be constructed by a plurality of ink slits formed on the substrate so as to connect to the corresponding nozzles; a plurality of pressure chambers formed on the substrate corresponding to the ink slits so as to connect to the ink slits; and an ink introducing mechanism for introducing the ink into the pressure chambers. When the path means is formed in such a construction, the discharge means is constructed to include a plurality of pressing elements attached on the substrate corresponding to the pressure chambers so as to apply the pressure to the corresponding pressure chambers depending on the command. Also, the ink introducing mechanism, for example, can be constructed to include an ink chamber formed in the position so as to surround and connect to the pressure chambers; and an ink introducing aperture for introducing the ink into the ink chamber.

In this construction, the ink discharge operation is as follows. First, the pressing element receiving the command applies the pressure to the corresponding pressure chamber. In response to this, the ink within the pressure chamber is fed to the corresponding ink slit. When the ink is fed to the ink slit, the ink is discharged from the corresponding nozzle. When the command is released, the ink of almost the same amount as the amount fed to the ink slit is introduced into the pressure chamber from the ink introducing mechanism.

Such a flat plate structure is formed by an anisotropic etching of a photosensitive glass substrate. That is, the above-described substrate is the photosensitive glass substrate, and the nozzles, the ink slits, the pressure chambers and the ink introducing mechanism are formed by the anisotropic etching of this substrate. In this manner, the etching depth can be exactly controlled, and thus the ink slits can be readily deepened. Further, by using the process for exposing the substrate while the substrate is rotated and inclined in the anisotropic etching, the nozzle having a tapered internal shape can be readily formed.

In the present invention, further, the nozzles can be separated into a plurality of groups. Of course, the zig zag arrangement is applied to each of the groups. By this method, groups of pressure chambers and ink slits corresponding to the groups of nozzles arranged in different portions can be groups of ink paths separated from each other. In this structure, by supplying different colors of inks to the groups of ink paths, color printing can be carried out. Also, the pressure variation in one group of ink path hardly affects the other ink paths. That is, the pressure variation can be decentralized. The number of the separated arrangement groups, for example, can be preferably three.

In this flat plate structure, the piezoelectric elements can be used as the above-described pressing elements. In the present invention, since the nozzle interval restriction is moderated by the zig zag arrangement, the depth of the ink paths can be shallowed in comparison with the thickness of the substrate. Hence, it becomes difficult for the vibration of one piezoelectric element to affect other parts of the head.

By providing the piezoelectric elements as the pressing elements to the corresponding pressure chambers, the ink can be selectively discharged from the nozzles. At this time, the structure of the piezoelectric elements can be a single piezoelectric substrate. This piezoelectric substrate has a circular or a circular arc form, and is formed with a common electrode on one surface and a plurality of individual electrodes on another surface corresponding to the pressure chambers. Hence, the piezoelectric substrate, each individual electrode and the common electrode can constitute a single piezoelectric element. That is, on a single piezoelectric substrate, a plurality of piezoelectric elements can be formed for every individual electrode. In this manner, a plurality of Piezoelectric elements can be constructed as one component, and thus its production can be made easy.

When the plurality of piezoelectric elements are formed to a single member, further, by providing concave surfaces between the electrodes, the piezoelectric elements can be electrically and acoustically insulated from each other. This improves the printing quality.

Also, by arranging the piezoelectric substrate so that the individual electrodes may face opposite sides of the pressure chambers, the wiring to the individual electrodes can be made easy. Also, by arranging the nozzles so that the nozzles may open to the opposite side of the piezoelectric element mount surface of the substrate, the wiring to the individual electrodes can be further readily carried out.

Further, by forming the opening of each nozzle to be substantially a circular form, occurrence of so-called satellite can be prevented to raise the printing quality.

As a typical example of the zig zag arrangement of the present invention, there is an inclined zig zag arrangement. This arrangement is a zig zag arrangement and further the first and second straight lines are inclined with respect to the printing direction and the direction perpendicular to the printing direction. In this arrangement, since the nozzle interval restriction can be further moderated, the above-described advantages can be made more remarkable.

The present invention can be constructed as a head unit. This head unit comprises:

a) an ink jet print head which includes:

a1) a plurality of nozzles arranged in a zig zag arrangement on a flat surface for discharging ink; and a2) discharge means for causing discharge of the ink from the nozzles; and b) a support for supporting the ink jet print head.

Further, the present invention can be constructed as a non-impact printer. This non-impact printer comprises:

a) a head unit which includes;

a1) an ink jet print head which includes:

a11) a plurality of nozzles arranged in a zig zag arrangement on a flat surface for discharging ink; and a12) discharge means for causing discharge of the ink from the nozzles; and a2) a support for supporting the ink jet print head; and b) an ink fountain for storing the ink to be discharged.

In these cases, the ink jet print head can be carried out in any of the above-described embodiments. When the piezoelectric elements are used as the discharge means, the head unit of the present invention is provided with a member for connecting the piezoelectric elements to a signal voltage source. Also, the non-impact printer of the present invention includes the signal voltage source for supplying the command as the signal voltage to the piezoelectric elements.

The non-impact printer can be constructed to include the following parts.

a) a platen for holding a printing medium;

b) a feed roller for feeding the printing medium to the platen along a direction perpendicular to the printing direction;

c) means for giving a feeding force to the feed roller;

d) a carriage movable to and from the platen in the printing direction; and e) means for giving a driving force to the carriage, f) wherein the head unit is relatively secured to the carriage, and with the moving of the carriage, the head unit is movable with respect to the printing medium in the printing direction, and wherein with the feeding of the printing medium by the feed roller, the head unit is movable with respect to the printing medium in a direction perpendicular to the printing direction.

In this apparatus of the present invention, in particular, the apparatus having the nozzles arranged in the inclined zig zag arrangement, the problem caused is that preprocessing such as an order operation and the like is previously applied to data to be used when the nozzles are driven. The third object of the present invention is to solve this problem to improve the usability. That is, the object is to provide a driving method practicable in an ink jet print head driver circuit side and an ink jet print head driver circuit for carrying out this driving method. Further, by describing this object in other words, the object is to provide an ink jet print head driver circuit provided with hardware capable of performing this preprocessing.

The driving method and the driver circuit of the present invention drive the nozzles arranged in the inclined zig zag arrangement, and the inclined zig zag arrangement satisfies the above-described three conditions. Now, in order to explain the driving method and the driver circuit of the present invention, the following terms are defined.

a) Odd numbers are assigned in order to the nozzles arranged on the first straight line. That is, the nozzles positioned in the odd number orders along the direction perpendicular to the printing direction within the plurality of nozzles are arranged on the first straight line; and b) Even numbers are assigned in order to the nozzles arranged on the second straight line. That is, the nozzles positioned in the even number orders along the direction perpendicular to the printing direction within the plurality of nozzles are arranged on the second straight line.

The driving method of the present invention comprises the following steps.

a) a first step for separating the input serial data into odd-side data and even-side data;

b) a second step for delaying the odd-side data a first predetermined time when the first straight line is positioned ahead of the printing direction and the even-side data the first predetermined time when the second straight line is positioned ahead of the printing direction; the first predetermined time corresponding to a printing direction interval between the nozzles being arranged adjacent to each other along the direction perpendicular to the printing direction;

c) a third step for delaying the odd-side data and the even-side data a second predetermined time; when the first straight line is positioned ahead of the printing direction, a delay target in the third step being the odd-side data delayed in the second step and the even-side data separated in the first step; when the second straight line is positioned ahead of the printing direction, a delay target in the third step being the odd-side data separated in the first step and the even-side data delayed in the second step; the second predetermined time being proportional to a product of the printing direction interval between the two nozzles arranged adjacent to each other on the same straight line and the position along the direction perpendicular to the printing direction of the nozzle arranged adjacent to each other on the same straight line; an order of the second predetermined time against the data to be delayed being changed depending on the printing direction so that the second predetermined time of the nozzles positioned ahead of the printing direction is relatively large and the second predetermined time of the nozzles positioned behind of the printing direction is relatively small;

d) a fourth step for carrying out a serial/parallel conversion of the odd-side and even-side data delayed in the third step to obtain odd-nozzle parallel data and even-nozzle parallel data; the odd nozzle parallel data and the even-nozzle parallel data having bit arrangements corresponding to the positions of the nozzles on the first and second straight lines along the direction perpendicular to the printing direction, respectively; and e) a fifth step for selectively discharging the ink from the nozzles by driving the discharging means on the basis of the odd-nozzle parallel data and the even-nozzle parallel data; the driving executing so that the ink being discharged from the nozzles located in positions corresponding to the bits of the odd-nozzle parallel data and the even-nozzle parallel have a predetermined data value and the ink not being discharged from the nozzles located in positions corresponding to the bits not having the predetermined value.

Also, the driver circuit of the present invention comprises the following:

a) odd-even separating means for carrying out the first step;

b) delay means for adapting the data order to the offset along the printing direction, thus carrying out the second step;

c) delay means for adapting the data order to the offset in inclined arrangement by carrying out the third step;

d) serial/parallel converting means for carrying out the fourth step; and e) driving means for carrying out the fifth step.

The present invention can be also expressed as a preprocessing circuit corresponding to a preprocessing part of the above-described driver circuit. This preprocessing circuit comprises the following:

a) odd-even separating means for carrying out the first step;

b) delay means for adapting the data order to the offset along the printing direction, thus carrying out the second step; and c) delay means for adapting the data order to the offset in inclined arrangement, thus carrying out the third step.

In the driving method and the driver circuit of the present invention, first, the input serial data are separated into odd-side data and even-side data. By this odd-even separation processing, the input serial data are divided into two groups. Then, depending on the positions of the nozzles and the printing direction, the delay processing of the groups of data is executed.

It is necessary to consider the positions of the nozzles in the inclined zig zag arrangement by separating the following two components. First is the positional relationship between the first and second straight lines. The data for driving the nozzles on one straight line which are ahead of the printing direction must be older data, for the time corresponding to the printing direction interval between the two straight lines, than the data for driving the nozzles on another straight line which are behind the printing direction.

Second is the mutual positional relationship between the nozzles arranged on the same straight line. In the inclined zig zag arrangement, since the two straight lines are inclined against the printing direction, the positions along the printing direction of the nozzles on the same straight line are different. The data for driving one nozzle at one position along the printing direction must be older data for the time corresponding to the printing direction interval between the nozzles adjacent on same straight line, than the data for driving another nozzle at the next position along the printing direction.

Further attention should be paid to the fact that such positional relationships depend on the printing direction.

In the present invention, the second step is executed in order to adapt the first relation. In this step, the odd-side data and the even-side data obtained in the first step are selectively delayed the predetermined amounts. According to the aforementioned definition of the terms, the nozzle arranged on the first straight line is given the odd number, and the nozzle arranged on the second straight line is given the even number. The target data for the delay in the second step are the data corresponding to this number. That is, when the first straight line is positioned ahead of the printing direction, the odd-side data are delayed, and when the second straight line is positioned ahead of the printing direction, the even-side data are delayed. At this time, the delay time is set depending on the adaptability of the data with the first relation. That is, the delay time at this time is the time equivalent to the interval along the printing direction between the adjacent nozzles along the direction perpendicular to the printing direction.

By executing the second step of such contents, the first relation concerning the positions of the nozzles can be satisfied on the data side in consideration of the printing direction. First, when the first straight line is positioned ahead of the printing direction, the odd-side data for use in driving the nozzles arranged on the first straight line are delayed. As a result, when it is observed at a certain timing, the odd-side data become the old data compared with the even-side data for use in driving the nozzles arranged on the second straight line. On the other hand, when the second straight line is positioned ahead of the printing direction, the even-side data for driving the nozzles arranged on the second straight line are delayed. As a result, when it is observed at a certain timing, the even-side data become the old data compared with odd-side data for use in driving the nozzles arranged on the first straight line. The time difference between both, in any case, becomes the time equivalent to the interval along the printing direction between the adjacent nozzles along the direction perpendicular to the printing direction.

Then, the third step is executed for adapting the second relation. In this step, the odd-side data obtained in the first step, the even-side data obtained in the first step, the odd-side data delayed in the second step and the even-side data delayed in the second step are selectively delayed.

First, when the first straight line is positioned ahead of the printing direction, the odd-side data delayed in the second step and the even-side data separated in the first step become the target for delay in this step. As described above, the odd-side data and the even-side data correspond to the first and second straight lines, respectively. On the other hand, when the first straight line is positioned ahead of the printing direction, in order to drive the nozzles present on the first straight line, the older data than the data used for driving the nozzles on the second straight line must be used. Hence, in this step, the odd-side data delayed on the second step and the even-side data separated in the first step are delayed for driving nozzles on the first and second straight line, respectively.

Next, when the second straight line is positioned ahead of the printing direction, the odd-side data separated in the first step and the even-side data delayed in the second step are the target for the delay in this step. When the second straight line is positioned ahead of the printing direction, in order to drive the nozzles present on the second straight line, the older data than the data used for driving the nozzles on the first straight line must be used. Hence, the odd-side data separated in the first step and the even-side data delayed in the second step are delayed for driving nozzles on the first and second straight line, respectively.

The delay time in the third step is different for every nozzle. This is the reason why the second relation to be adapted in this step is the positional relation of the nozzles arranged on the same first or second straight line. In the setting of the delay time in this step, the positions of the nozzles on each straight line must therefore be considered. More specifically, the delay time in this step becomes the time proportional to the product of the interval along the printing direction of the adjacent two nozzles on the same straight line and the position along the direction perpendicular to the printing direction of each nozzle on the same straight line. Also, it is necessary to determine the setting of the delay time depending on the printing direction. That is, the order of the delay time of the data to be the target for the delay is changed depending on the printing direction so as to be relatively large for the nozzle positioned ahead of the printing direction and to be relatively small for the nozzle positioned behind the printing direction.

As described above, the two groups of the date adapted for the first and second relations are used for the driving of the corresponding nozzles. That is, in the fourth step, the serial/parallel conversion of these data is executed, and in the fifth step, the parallel data obtained in the fourth step are actually used for the discharge control of the ink.

In more detail, in the fourth step, the serial/parallel conversion of the odd-side data delayed in the third step is carried out to obtain the odd-side parallel data. This odd-side parallel data have the bit arrangement corresponding to the position of the nozzle along the direction perpendicular to the printing direction on the first straight line. In the fifth step, based on the odd-side parallel data, the discharge means is driven, and the ink is selectively discharged from the plurality of nozzles. In this case, the discharge is executed, for example, the bits corresponding to the nozzles have the predetermined value such as "1".

Similarly, in the fourth step, the serial/parallel conversion of the even-side data delayed in the third step is carried out to obtain the even-side parallel data. This even-side parallel data have the bit arrangement corresponding to the position of the nozzle along the direction perpendicular to the printing direction on the second straight line. In the fifth step, based on the even-side parallel data, the discharge means is driven, and the ink is selectively discharged from the plurality of nozzles.

By these driving method or the driver circuit, there is no need to previously apply preprocessing to the input serial data, and thus the usability is extremely improved. Also, by implementing the circuit as an IC or LSI, the circuit structure of the ink jet printer can be simplified. Also, it is possible to construct the circuit executing the second to fifth steps by the odd and even systems of unit circuits, and hence the circuit construction can be produced into units and thus can be simplified.

Further, the printing direction can be detected by a printing direction signal. That is, it is sufficient to switch the operations of the second and third steps by using the printing direction signal exhibiting the printing direction. More specifically, the selection of the targets for the delay and the setting of the delay time can be executed depending on the value of the printing direction signal.

Also, the odd-even separation can be executed by using two-phase clocks. That is, prior to the first step, the odd-side and even-side clocks of mutually opposite phases are generated. This two-phase clock generation operation is realized by dividing the clock synchronized with the input serial data.

When the two-phase clocks are used in the odd-even separation, in the first step, by latching the input serial data depending on the odd-side clock, the odd-side data are obtained, and by latching the input serial data depending on the even-side clock, the even-side data are obtained.

In the second step, first, when the first straight line is positioned ahead of the printing direction, the odd-side clock is selected as the first clock for delay, and when the second straight line is positioned ahead of the printing direction, the even-side clock is selected as the first clock for delay. Then, the input serial data are latched depending on the first clock for delay and the predetermined amount of bit shift of the data is carried out to execute the delay of the first relation.

In the third step, first, the serial/parallel conversion of the odd-side data and the even-side data is carried out depending of the respective odd-side and even-side clocks. Next, the odd-slide data and the even-side data obtained in the serial/parallel conversion are delayed for every bit so as to adapt for t;he second relation. Further, the bits of the delayed odd-slide and even-side data are multiplexed, respectively, to perform the parallel/serial conversion. At this time, the multiplexing directions are switched depending of the printing direction so that the bit order of the odd-side data or, the even-side data before the serial/parallel conversion depending on the odd-side clock or the even-side clock may be restored.

Next, in the fourth step, the serial/parallel conversion of the odd-side data and the even-side data delayed in the third step is carried out depending on the odd-side clock and the even-side clock to obtain the odd-nozzle parallel data and the even-nozzle parallel data.

BRIEF DESCRIPTION OF THE DRAWINGS

The objects, features and advantages of the present invention will become more apparent from the consideration of the following detailed description, taken in conjunction with the accompanying drawings, in which.

DESCRIPTION OF THE PREFERRED EMBODIMENTS

Figure 1:
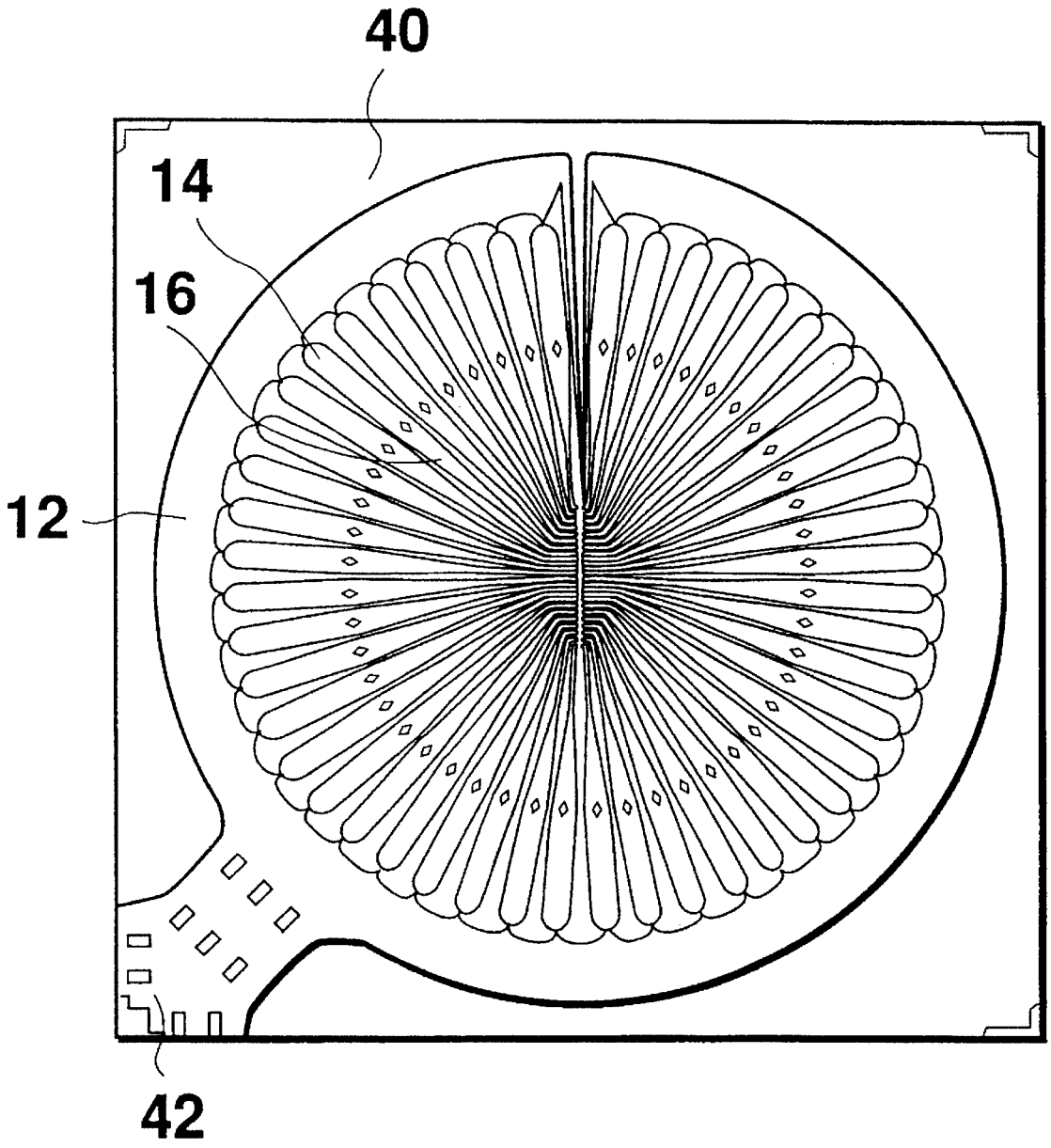
FIG. 1 is a top view of a first embodiment of an ink jet print head according to the present invention.

The present invention will now be described in connection with its preferred embodiments with reference to the accompanying drawings, wherein like reference characters designate like or corresponding parts throughout the views and thus the repeated description thereof can be omitted for brevity.

Modification of the prior art

Before explaining embodiments of the present invention, an improvement of an arrangement of nozzles of an ink jet print head made by inventors of the present invention will now be described in connection with FIG. 33 and FIG. 34.

Figure 32:
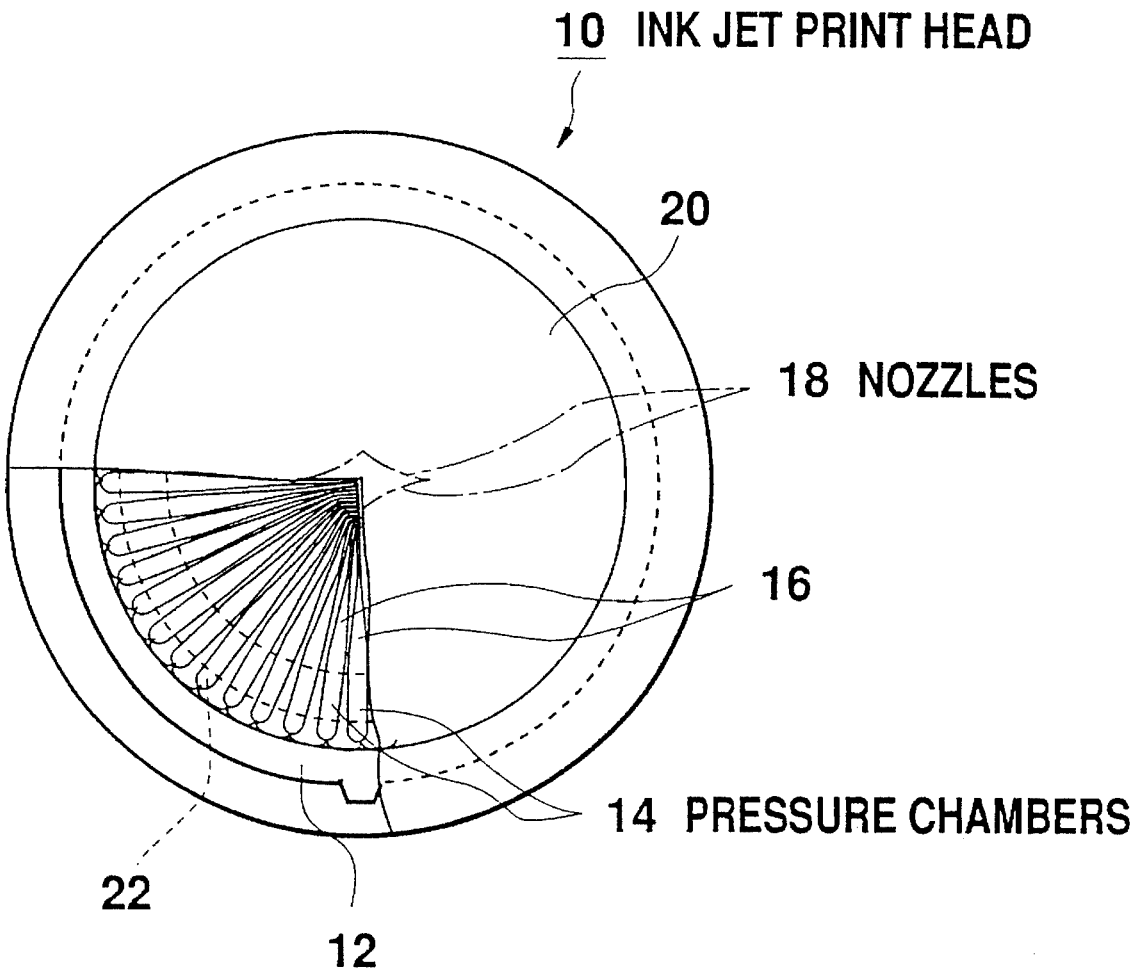
Fig. 32 Prior Art
FIG. 32 is a top view, partly in section, of a conventional ink jet print head.

For example, an arrangement of nozzles 18 of an ink jet print head capable of improving problems of the prior art described above is shown in FIG. 33. In this case, the nozzles 18 are arranged along a straight line. In the conventional rhombic arrangement of the nozzles 18 shown in FIG. 32, paying attention to one side of the rhombic form, the ink slits 16 for supplying the ink to the nozzles 18 arranged on this side are all present on the same side. On the contrary, in the straight line arrangement of the nozzles shown in FIG. 33, the ink slits 16 for supplying the ink to the nozzles 18 are alternately present on both the left and right sides of the straight line. For example, in FIG. 33, the ink slit 16 of the uppermost nozzle 18 is arranged on the left side, and the ink slit 16 of the next nozzle 18 is on the right side. The ink slit 16 of the next nozzle 18 is on the left side, and the ink slit 16 of the lowermost nozzle 18 is on the right side. That is, the ink slits 16 of the nozzles 18 are alternately arranged on both the left and right sides of the straight line. In this case, the nozzles 18 are arranged on the straight line and the ink slits 16 of the nozzles 18 are alternately drawn out of the nozzles 18 from the left and right sides. As a result, compared with the prior art shown in FIG. 32, the interval between the nozzles 18 can be reduced and thus the dot interval can be diminished.

Figure 33:
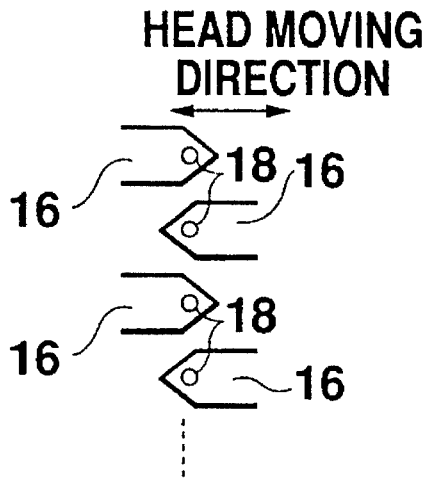
FIG. 33 is a top view of an ink jet print head having nozzles arranged along a vertical line.
Figure 34:
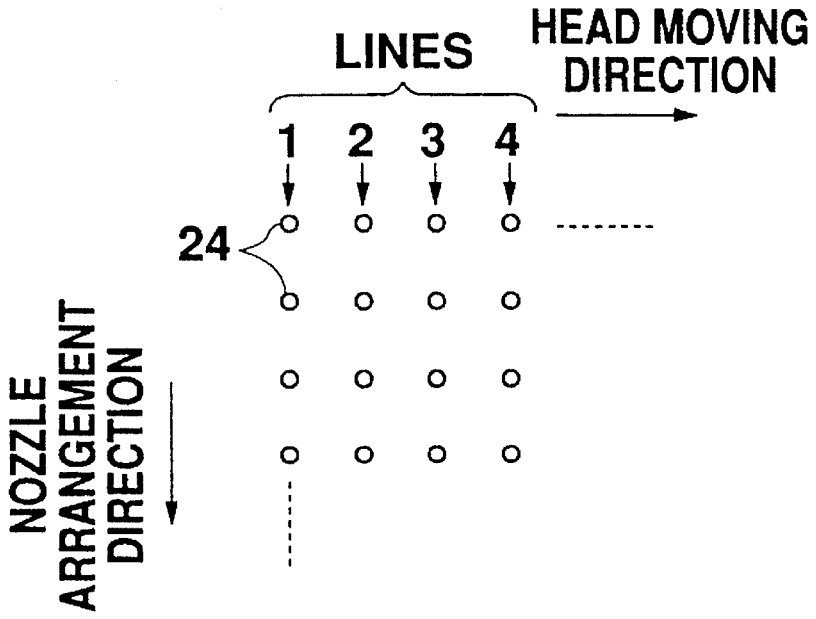
FIG. 34 is top view showing a dot pattern obtained by printing by using the head shown in FIG. 33.

When the printing is cart led out by using the head having the nozzles 18 arranged as described above, the head is moved in the direction perpendicular to the arranging direction of the nozzles 18, as indicated by an arrow shown in FIG. 33. By discharging the ink at the same time from the nozzles 18 while the head is moved in such a direction, as shown in FIG. 34, one straight line is formed by dots 24. Since one line is obtained per one discharge, by repeating a discharge control at a predetermined timing, a plurality lines can be successively printed.

Driver circuit for thermal printer

Figure 35:
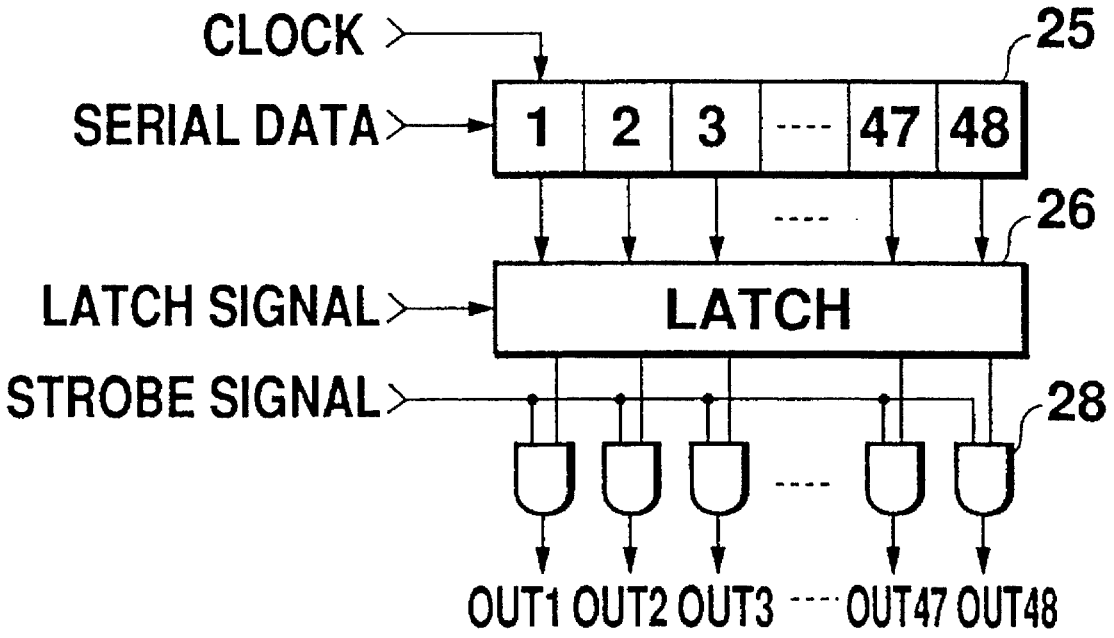
Fig. 35 Prior Art
FIG. 35 is a block diagram of a conventional driver circuit for a thermal printer.

When such a driving of the head is carried out, a driver circuit for a thermal printer conventionally known can be used. In FIG. 35, there is shown a driver circuit for a thermal printer.

The driver circuit is a circuit for performing a printing of 48 dots per one line and includes a shift register 25, a latch 26 and a plurality (48) of ANDs 28. The shift register 25 converts input serial data into 48 bits of parallel data at a clock timing. That is, the shift register 25 acts as a serial/parallel (S/P) converter of 48 bits. The latch 26 latches the parallel data output from the shift register 25 according to a latch signal supplied from an external device such as a CPU for a print control.

The data latched in the latch 26 are supplied as drive signals to the head of the thermal printer, that is, heating elements constituting the thermal head, more specifically, to bases (gates) of transistor s for driving the heating elements. In other words, when one bit of data represents one predetermined value such as "1" and another bit of data represents another predetermined value such as "0" in the latch 26, the heating element corresponding to one bit of data is heated and the heating element corresponding to another bit of data is not heated.

In this case, the heating period is controlled by a strobe signal. That is, the 48 ANDs 28 corresponding to 48 bits in the latch 26 input the data from the latch 26 and also input the strobe signal from the external device. Hence, the aforementioned heating operation is carried out in only the on-period of the strobe signal. That is, the strobe signal is used for controlling the printing density of the dots. In this case, OUT1 to OUT48 are outputs to be supplied to the transistors for driving the heating elements of the bits.

The above-described construction can be applicable to the ink jet print head driver circuit. However, in the ink jet printer, the output function is borne by not the heating elements of the thermal printer but the plezo-electric elements (see FIG. 32). Hence, in order to apply the circuit shown in FIG. 35 to the ink jet print head driver circuit, it is necessary to modify the circuit bearing the output function. More specifically, the outputs OUT1 to OUT48 are required to be supplied to not the circuit for controlling the power supply to the heating elements but a push-pull driver circuit capable of performing the charge and discharge of the piezoelectric elements.

On the other hand, recently, higher definition printing has been required, and thus the shortening of the dot interval is being investigated. In the ink jet print head shown in FIG. 33, the interval between the dots 24 is basically decided by the internal between the nozzles 18 or the interval between the ink slits 16. In turn, since the interval between the nozzles 18 or the ink slits 16 connected thereto is determined by their processing steps, it can be considered that there is a limit due to the processing for obtaining the higher definition printing by the reduction of the interval between the dots 24.

The embodiments of the present invention

The embodiments hereinafter described are constructed from the viewpoint of the reduction of the interval between the dots 24. From the following description, it will become more apparent for those skilled in the art that this object can be properly achieved and various changes and modifications in the embodiments can be made. Further, it will become apparent that the embodiments are not obtained by a simple combination of the structures shown in FIGS. 32 to 35.

The first embodiment

Figure 2:
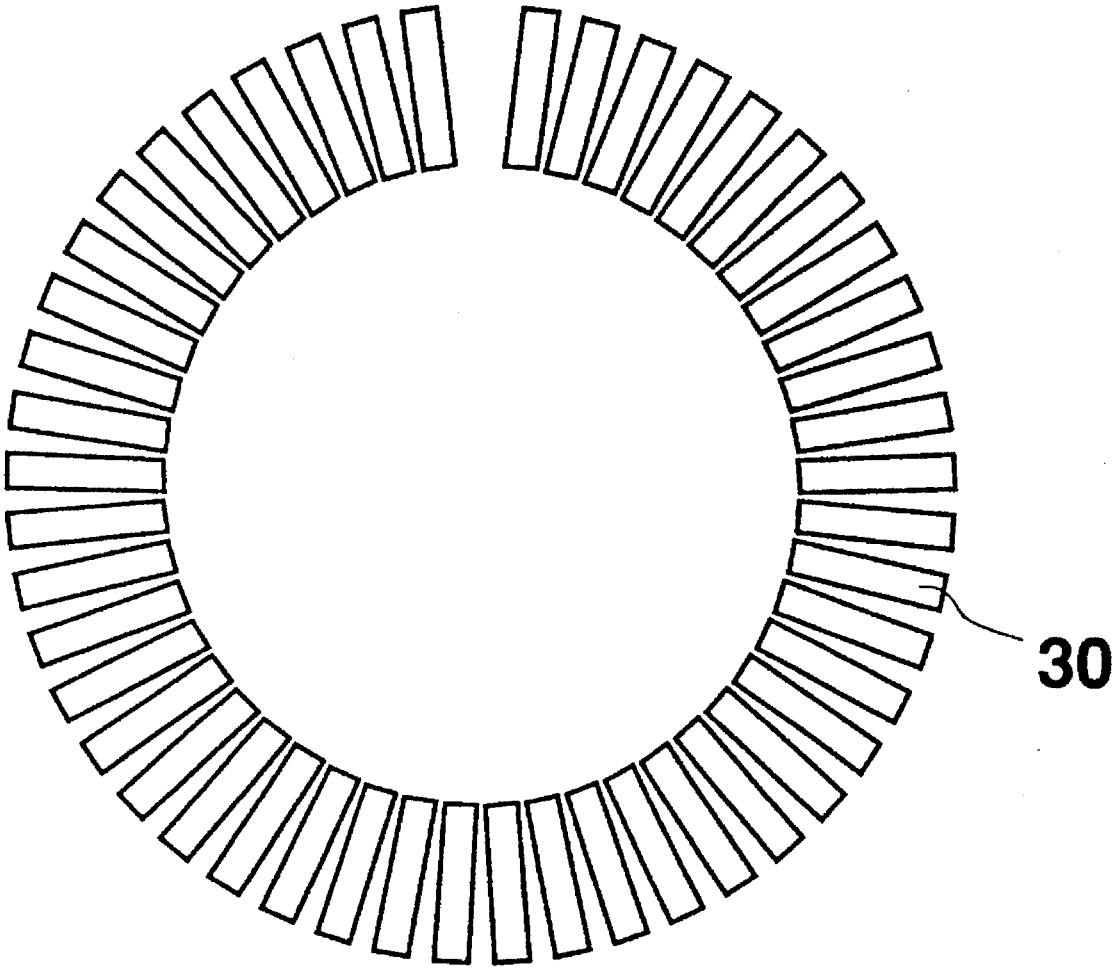
FIG. 2 is a top view showing an arrangement of piezoelectric elements shown in FIG. 1.
Figure 3:
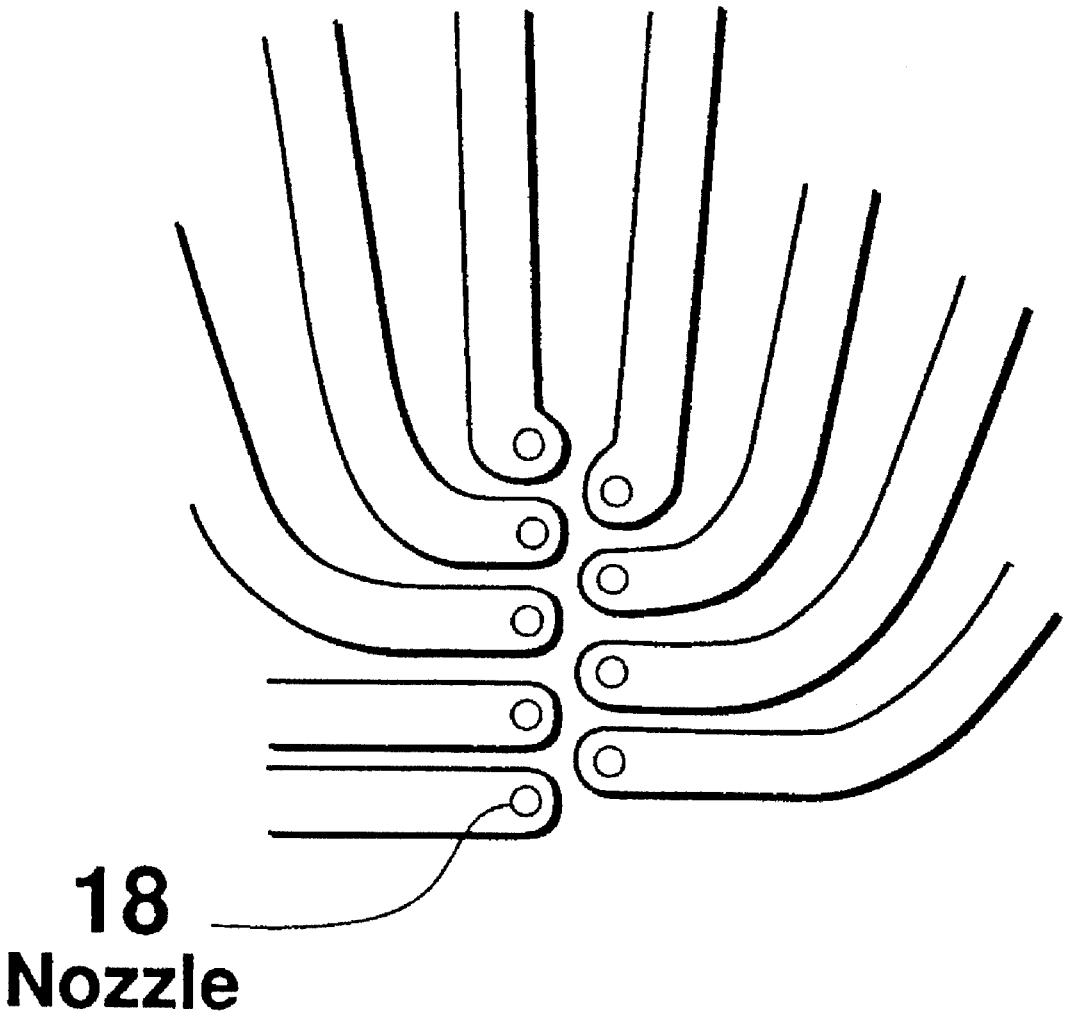
FIG. 3 is an enlarged top view showing a construction near nozzles shown in FIG. 1.

In FIGS. 1 to 3, there is shown the first embodiment of an ink jet print head according to the present invention. As shown in these drawings, this embodiment is characterized by a zig zag arrangement of the nozzles 18.

As shown in FIG. 1, an ink chamber 12 is formed as a circle, and pressure chambers 14 for receiving the ink from the ink chamber 12 and storing the ink therein are arranged around the circle inside the ink chamber 12. The pressure chambers 14 are connected to respective ink slits 16, and the ink slits 16 lead the ink to the respective nozzles 18 from the respective pressure chambers 14. The nozzles 18 are located near the center of the circle.

The ink chamber 12, the pressure chambers 14, the ink slits 16, the nozzles 18 and the like are formed on a rectangular substrate 40 by etching. Also, an ink introducing aperture 42 for introducing the ink to the ink chamber 12 is formed in one corner of the substrate 40 by etching.

As shown in FIG. 2, in this embodiment, a plurality of piezoelectric elements 30 are arranged in an annular shape. The piezoelectric elements 30 corresponding to the pressure chambers 14 shown in FIG. 1 are attached to the respective pressure chambers 14 in the arrangement shown in FIG. 2. Hence, in this case, since each piezoelectric element 30 is provided to each pressure chamber 14, the ink discharge from respective nozzles 18 can be controlled independently of each other.

As shown in FIG. 3, the nozzles 18 have substantially a circular form. Hence, a form of an ink drop discharged from the nozzle 18 becomes substantially a circular form, and a stable printing without satellite can be carried out. The half of the nozzles 18 supplied with the ink from the left hand side in the figure are arranged along one vertical line, and the other half of the nozzles 18 supplied with the ink from the right hand side are arranged along another vertical line. Also, the nozzles 18 arranged on the left hand side line are offset by the half interval with respect to the nozzles 18 arranged on the right hand side line. This arrangement of the nozzles 18 is hereinafter referred to as a zig zag arrangement.

When the printing is executed in this embodiment, a voltage is selectively applied to the piezoelectric elements 30 so as to selectively excite the same. Then, the ink is caused to flow into the pressure chambers 14 corresponding to the excited piezoelectric elements 30 from the ink chamber 12, and the ink flows out from the pressure chambers 14 to the nozzles 18 via the ink slits 16. When the excitation of the piezoelectric element 30 is released, almost the same amount of ink is introduced into the corresponding pressure chamber 14.

In this embodiment, since the interval between the nozzles 18 arranged in the vertical direction is substantially shortened due to the zig zag arrangement of the nozzles 18, the printing can be carried out so as to perform relatively high dot density.

Further, since the nozzles 18 possess a substantially circular form, the form of the ink drop discharged from the nozzles 18 is substantially circular, and thus the printing becomes stable. For the same reason, an occurrence of a so-called satellite can be prevented.

Also, the flat surface structure in this embodiment can be formed by anisotropic etching of a photosensitive glass substrate. That is, although conventionally a substrate capable of being subjected to only isotropic etching is used, by using the photosensitive glass substrate adaptable to the anisotropic etching, the depth of the ink chamber 12 and the ink slits 16 can be readily controlled in the production of the ink jet print head. As a result, compared with the conventional ink jet print head, in particular, in the ink slits 16, the depth of the part near the nozzles 18 can be increased. When the depth of the ink slits 16 is enlarged, the width of the ink slits 16 near the nozzles 18 can be thinned. That is, by increasing the depth of the ink slits 16, in spite of reducing the width, the cross section can be enlarged. Hence, the interval between the ink slits 16 can be reduced without increasing the viscous drag, and thus the interval between the nozzles 18 can be reduced. Also, the production process can be simplified.

In addition, since the pressure chambers 14 are arranged in a circle, similar to the conventional embodiment, the length of the ink slits 16 can be almost equal to realize the equalization of the viscous drag. Also, since the pressure chambers 14 are provided in the radial form, the number of nozzles 18 per unit area can be enlarged.

Further, it is readily understood for those skilled in the art that, even when the pressure chambers 14 are arranged in a circular are, the same effects can be obtained. Of course, this is the same in the following embodiments.

The second embodiment

Figure 4:
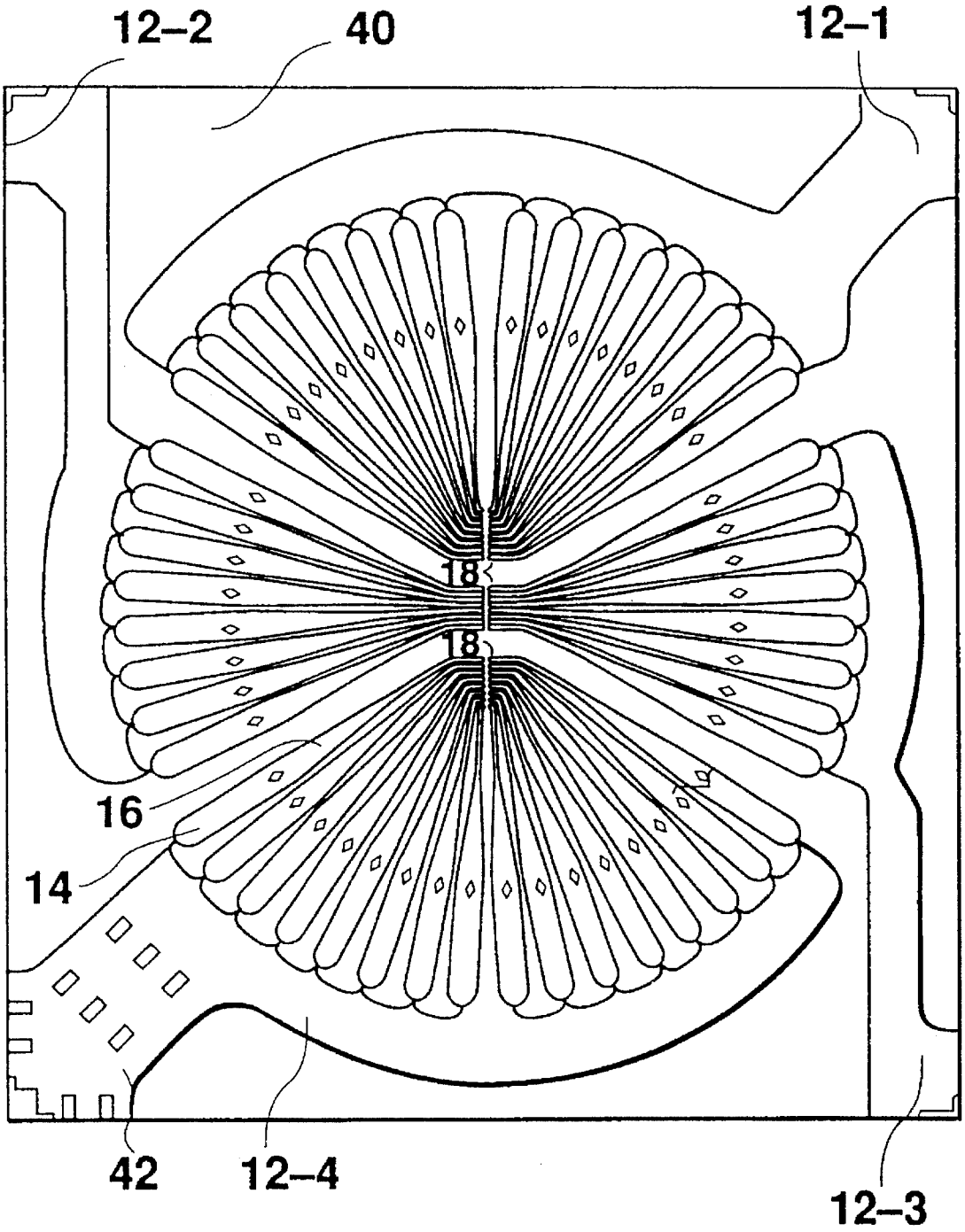
FIG. 4 is a top view of a second embodiment of an ink jet print head according to the present invention.

In FIG. 4, there is shown the second embodiment of an ink jet print head according to the present invention.

In this embodiment, the nozzles 18 are separately formed in three parts near the central part of the circle, and the ink chamber 12 is separated into four ink chambers 12-1, 12-2, 12-3 and 12-4. First, to a first group of nozzles 18 shown in the upper part in the figure, the ink is supplied from the first ink chamber 12-1. To the second group of nozzles 18 shown in the middle part, the ink is supplied from the second and third ink chambers 12-2 and 12-3. To the third group of nozzles 18 shown in the lower part, the ink is supplied from the fourth ink chamber 12-4.

Hence, in this embodiment, compared with the first embodiment, color printing can be carried out. More specifically, by supplying different colors (cyan, magenta and yellow) of inks to the first ink chamber 12-1, the second and third ink chambers 12-2 and 12-3 and the fourth ink chamber 12-4, color printing can be performed. Also, since the nozzles 18 are provided in the zig zag arrangement, the multi-dot printing can be carried out in the same manner as the first embodiment.

Further, in this embodiment, since the ink chambers 12-1, 12-2, 12-3 and 12-4 are separated for every group of nozzles 18, the pressure variation caused in one pressure chamber 14 with the ink discharge can not easily affect the nozzles 18 supplied with the ink from another ink chamber. As a result, a relatively stable printing quality can be obtained.

Further, the nozzles 18 can be separated into four groups, and in this case, one more color ink such as black ink can be supplied. Of course, according to the present invention, the number of the nozzle separation groups is not restricted.

The third embodiment

Figure 5B:
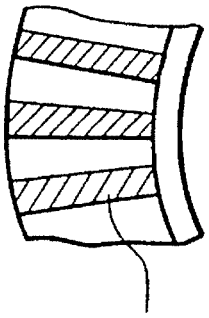
FIG. 5 is a top view showing a piezoelectric substrate of a third embodiment of an ink jet print head according to the present invention.
Figure 5A:
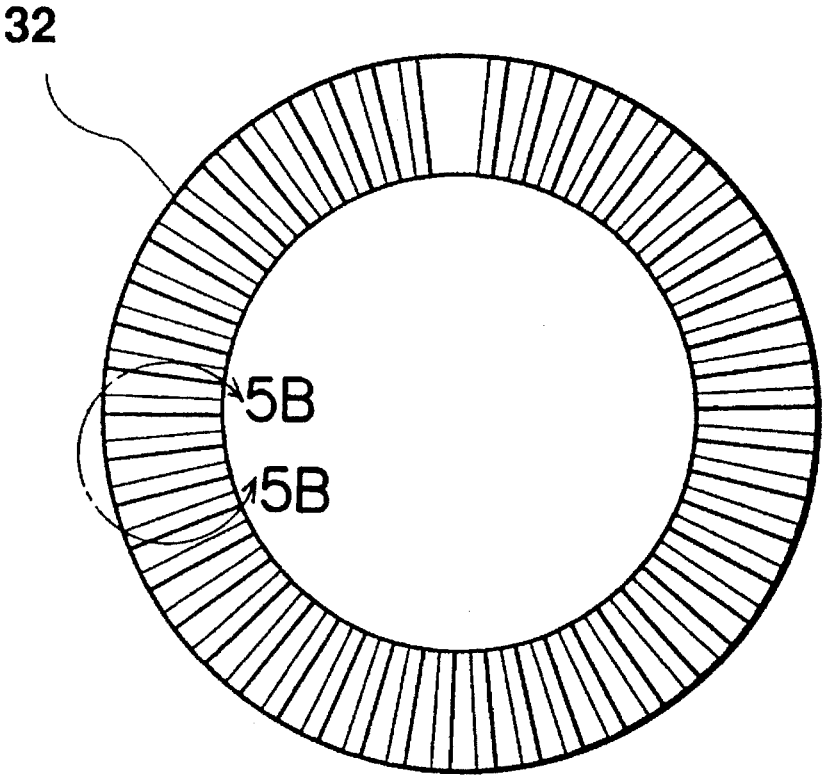

In FIG. 5, there is shown a piezoelectric substrate 32 in the third embodiment of an ink jet print head according to the present invention.

In this embodiment, as shown by an enlarged part in the left hand side in FIG. 5, a plurality of electrodes 34 are separately formed on a piezoelectric substrate 32 at a predetermined interval. Also, a common electrode (not shown) is formed on the opposite surface of the piezoelectric substrate 32 to the surface on which the electrodes 34 are formed. The other parts of the ink jet print head are the same as those of the first or second embodiment, and thus they are not shown and not described for brevity.

In this embodiment, there is no need to attach a number of piezoelectric elements 30 on the substrate 40, which is different from the first embodiment. Also, since the piezoelectric substrate 32 has an annular form, the interval between the electrodes 34 can be designed to be relatively large, and thus interference between the electrodes 34 is less likely to be caused. In this case, the piezoelectric substrate 32 can be arranged so that the side of the electrodes 34 or the common electrode may face the pressure chambers 14. Both ways are possible. When the common electrode side of the piezoelectric substrate 32 is attached to face the pressure chamber side, the wiring to connect the electrodes 34 can be readily carried out.

The fourth embodiment

Figure 6B:
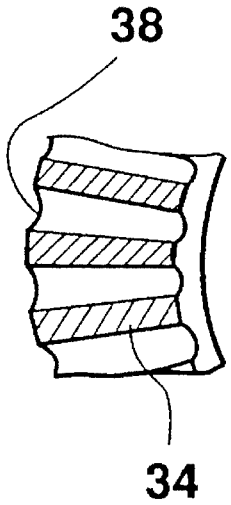
FIG. 6 is a top view showing a piezoelectric substrate of a fourth embodiment of an ink jet print head according to the present invention.
Figure 6A:
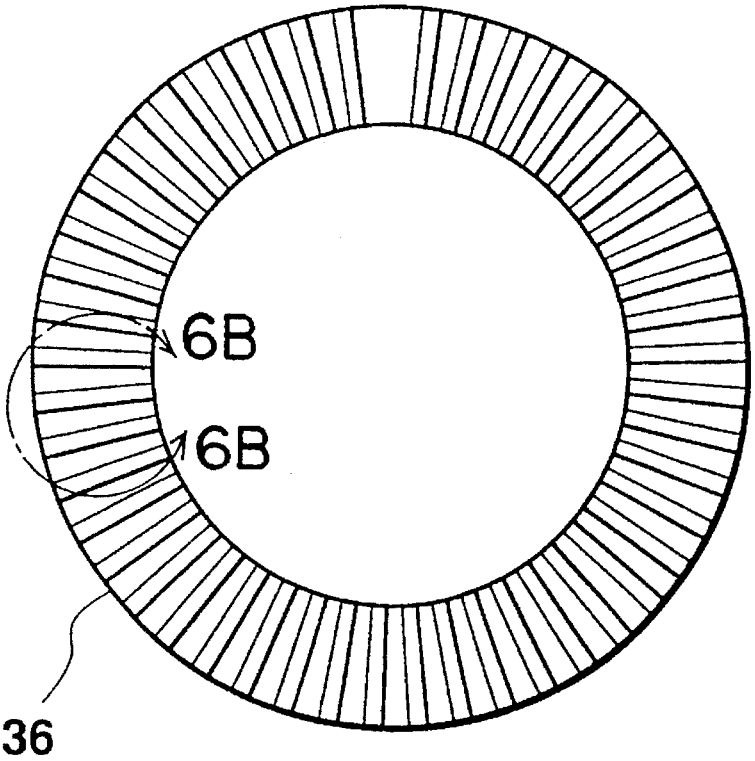

In FIG. 6, there is shown a piezoelectric substrate 36 in the fourth embodiment of an ink jet print head according to the present invention.

In this embodiment, the piezoelectric substrate 36 has the same construction as the piezoelectric substrate 32 in the third embodiment shown in FIG. 5, except that notches or grooves 38 are formed between the electrodes 34 on the piezoelectric substrate 36. Accordingly, the electrodes 34 can be electrically and acoustically insulated or separated from each other. Hence, the interference between the electrodes 34 can be reduced considerably, and printing with high accuracy can be carried out.

The fifth embodiment

Figure 7:
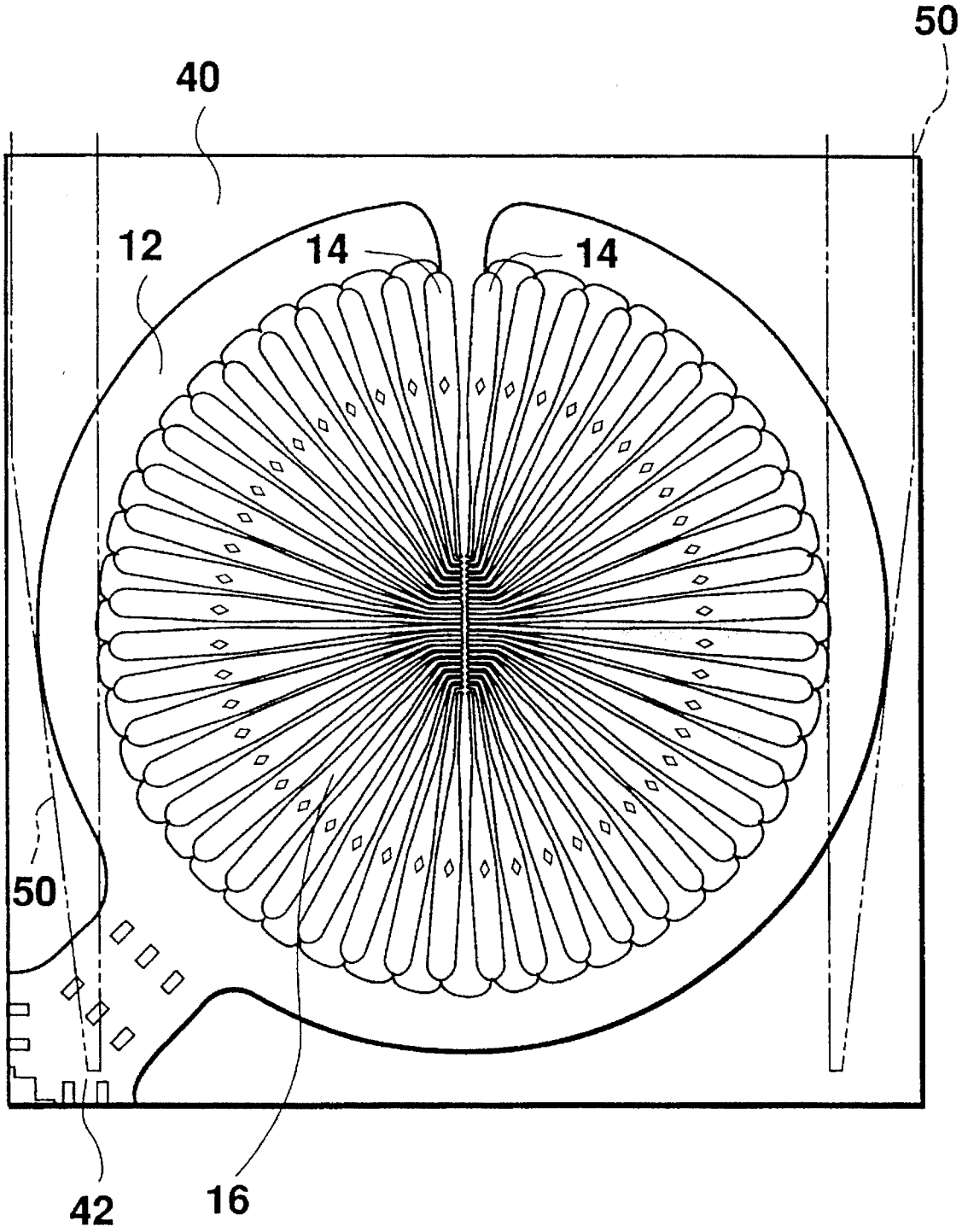
FIG. 7 is a top view of a fifth embodiment of an ink jet print head according to the present invention.

In FIG. 7, there is shown the fifth embodiment of an ink jet print head according to the present invention.

Figure 8:
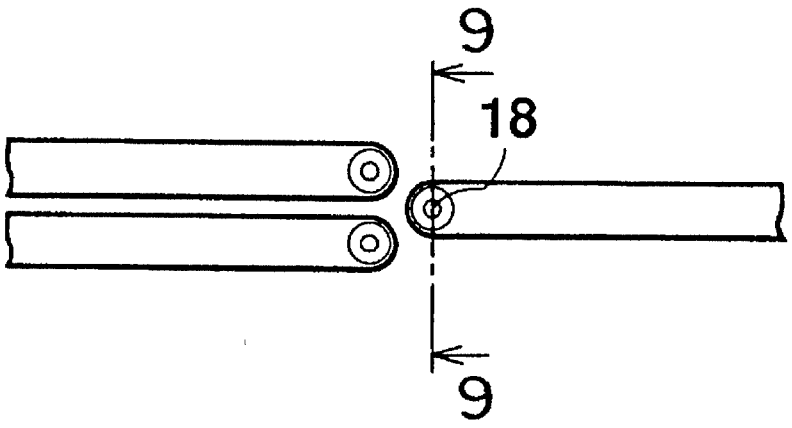
FIG. 8 is an enlarged top view showing a construction near nozzles shown in FIG. 7.
Figure 9:
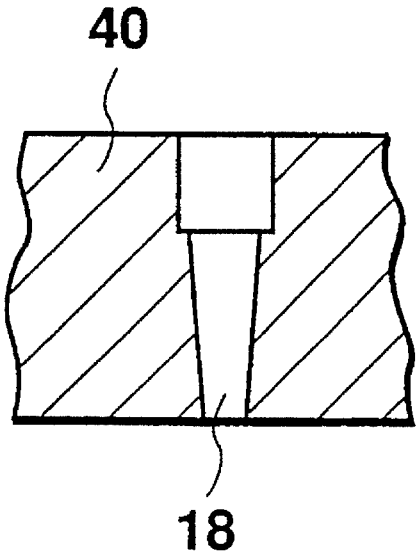
FIG. 9 is a cross sectional view, taken along the line B—B shown in FIG. 8.

In this embodiment, in the substrate 40, the nozzles 18 are formed so as to penetrate in the thickness direction by etching. FIG. 8 shows an enlarged form near the nozzles 18, and FIG. 9 is an enlarged cross section of the nozzle 18, taken along the line B—B in FIG. 8. In this case, the hole of the nozzles 18 is tapered off at an angle of approximately 2°.

Figure 10:
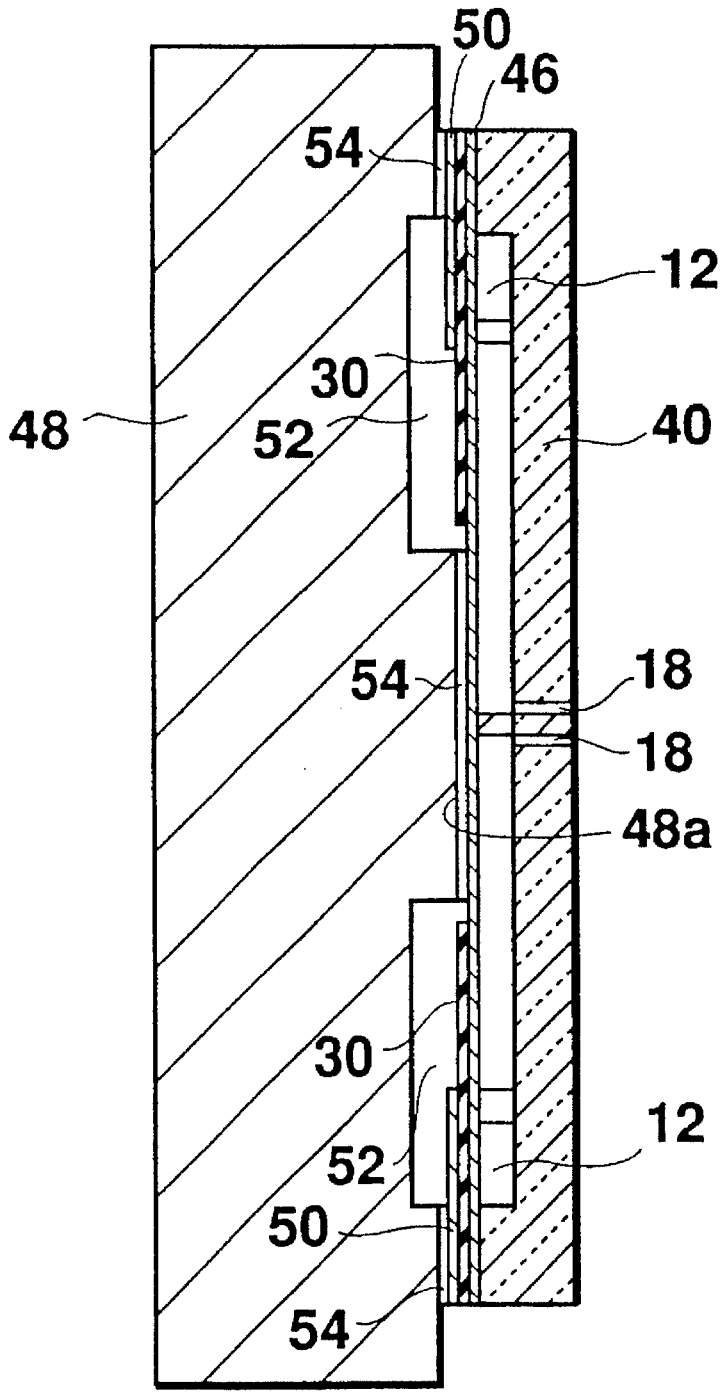
FIG. 10 is a longitudinal cross sectional view of the ink jet print head shown in FIG. 7, mounted on a support.

As shown in FIG. 10, a diaphragm 46 and piezoelectric elements 30 are mounted on the substrate 40, and the substrate 40 is mounted on a support 48. For example, the material of the diaphragm 46 is glass. The diaphragm 46 is mounted on the substrate 40 by using screws, an adhesive or the like so as to cover the pressure chambers 14, the ink slits 16 and the ink introducing aperture 42. At this time, the piezoelectric elements 30 are attached onto the diaphragm 46 in the positions corresponding to the pressure chambers 14. To each piezoelectric element 30, a flexible cable 50 is connected. The flexible cable 50 acts to apply a signal voltage output from a signal source (not shown) to each piezoelectric element 30.

The support 48 is composed of a material having a high rigidity such as a metal, a high rigidity resin or the like. On the support 48, the substrate 40 is mounted. In the support 48, hollows 52 are formed in the surface supporting the substrate 40 in the portions corresponding to the piezoelectric elements 30. In FIG. 10, the adhesive is filled up in portions 54 so as to fix the substrate 40 on the support 48.

Now, when the voltage is applied to one piezoelectric element 30 from the signal source via the flexible cable 50, the corresponding part of the diaphragm 46 is stressed by the piezoelectric function of the piezoelectric element 30, and the volume in the corresponding pressure chamber 14 is changed. Thus, the ink is discharged from the corresponding nozzle 18. In this embodiment, since the diaphragm 46 is supported by a projection 48*a* of the support 48, only the part corresponding to the excited piezoelectric element 30 in the diaphragm 46 is deformed, but the parts corresponding to the adjacent piezoelectric elements 30 to the excited piezoelectric element 30 are not unnecessarily bent. After the ink discharging operation, the diaphragm 46 is returned to the original state. Since the negative pressure is generated in the corresponding pressure chamber 14 by this motion, the same amount of ink as the discharged amount is supplied to the corresponding pressure chamber 14 via the ink introducing aperture 42 and the ink chamber 12.

As described above, in this embodiment, the head structure of the first embodiment is described along with its support means. Hence, the head structure itself is not restricted to that of the first embodiment, and thus the head structures of the second to fourth embodiments can be used. Of course, the basic concept of the present invention is not restricted to only the first to fourth embodiments.

The construction of the fifth embodiment, as described hereinafter in connection with FIG. 11, can be applied to a non-impact printer. Accordingly, compared with a conventional printer, a non-impact printer with an improved printing quality and high performance can be implemented.

Figure 11:
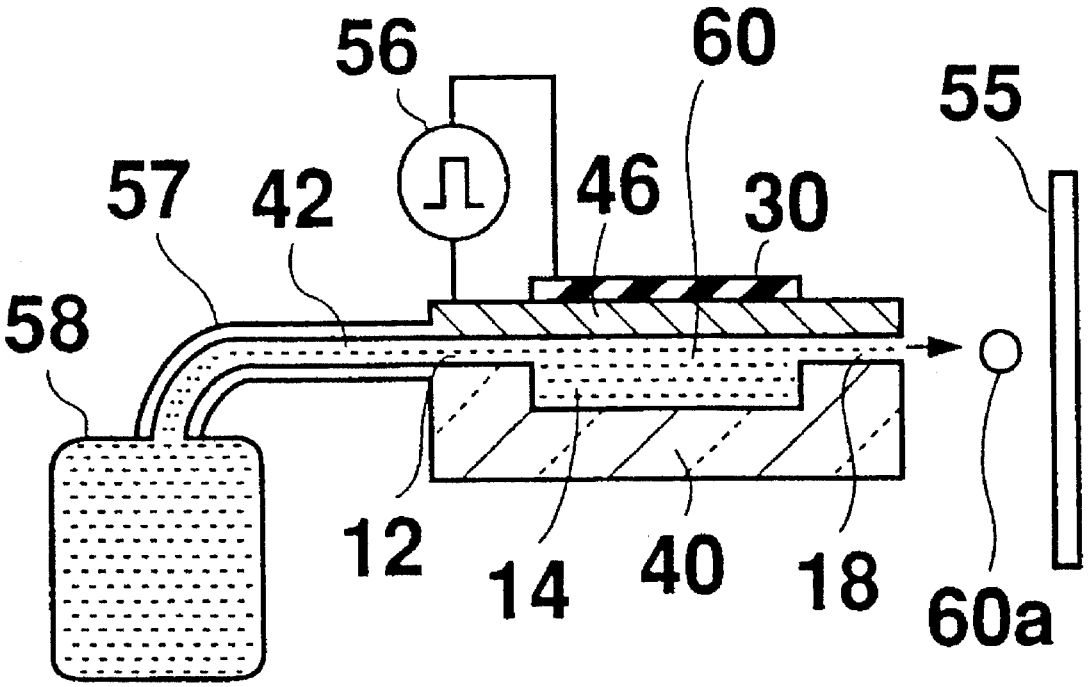
FIG. 11 is a schematic view showing a basic principle of a Kyser piezoelectric head unit.

In FIG. 11, there is shown a non-impact printer, in particular, a basic construction of its head unit. This head unit uses the so-called Kyser piezoelectric head unit as the basic principle.

The ink jet printers are roughly classified into two types such as a continuous type and an on-demand type. In the former, the ink is continuously ejected from the nozzle and the unnecessary ink for the printing is collected for reuse. Hence, since a head response is high but a mechanism for collecting the ink is required, the apparatus is complicated and expensive. In turn, in the latter, since the ink eject is executed only when it is required, the head response is low but the apparatus is simple and inexpensive.

The on-demand type includes an electrostatic attraction (deflection) type for drawing the ink from the nozzle by the electro-static force and a pressure pulse type for pushing out the ink from the nozzle by applying a pressure to the pressure chamber. Further, the pressure pulse type includes a piezoelectric type and a bubble type. In the piezoelectric type, the ink is pressurized by a piezoelectric element, and there are two types such as a one chamber type in which the ink is supplied from the respective pressure chambers to the corresponding nozzles and a two chamber type in which the ink is supplied from the respective pressure chambers to the corresponding temporary storing chambers. In the latter, the temporary storing chambers have a large diameter than the diameters of the inlet apertures of the corresponding nozzles. The temporary storing chambers act as absorbers of irregular pressure variations. Further, the one chamber type includes a Kyser type having a flat pressure chamber and a Zoltan type having a cylindrical pressure chambers. The two chamber type includes a Stemme type in which the ink is supplied to the temporary storing chambers near the nozzles.

Hence, in this embodiments, an ink jet printer is a relatively low head response type and is capable of performing high quality printing. In this case, as the ink, both water based and oil based inks can be used.

It is necessary to take into consideration that FIG. 11 shows not an actual structure of a head unit but its principle. For example, in FIG. 11, though a nozzle 18 is open in a parallel direction against a surface of a substrate 40, when the structure shown in FIG. 10 is applied to that shown in FIG. 11, it will be apparent that the nozzle 18 is open in the perpendicular direction to the surface of the substrate 40. Also, the reason why a support 48 is not shown is only for simplicity of the drawing. In FIG. 11, a signal source 56 applies a signal voltage to a piezo-electric element 30 attached on a diaphragm 46, and an ink fountain 58 supplies ink 60 to a pressure chamber 14 via an ink introducing aperture 42 and an ink chamber 12. An ink drop 60*a* is discharged toward a printing medium 55 such as paper a plastic sheet or the like from the nozzle 18. A pipe 57 connects the ink fountain 58 with the ink introducing aperture 42, and the ink 60 is caused to flow within the pipe 57 by a capillary tube force to be led to the ink introducing aperture 42.

The sixth embodiment

Figure 12:
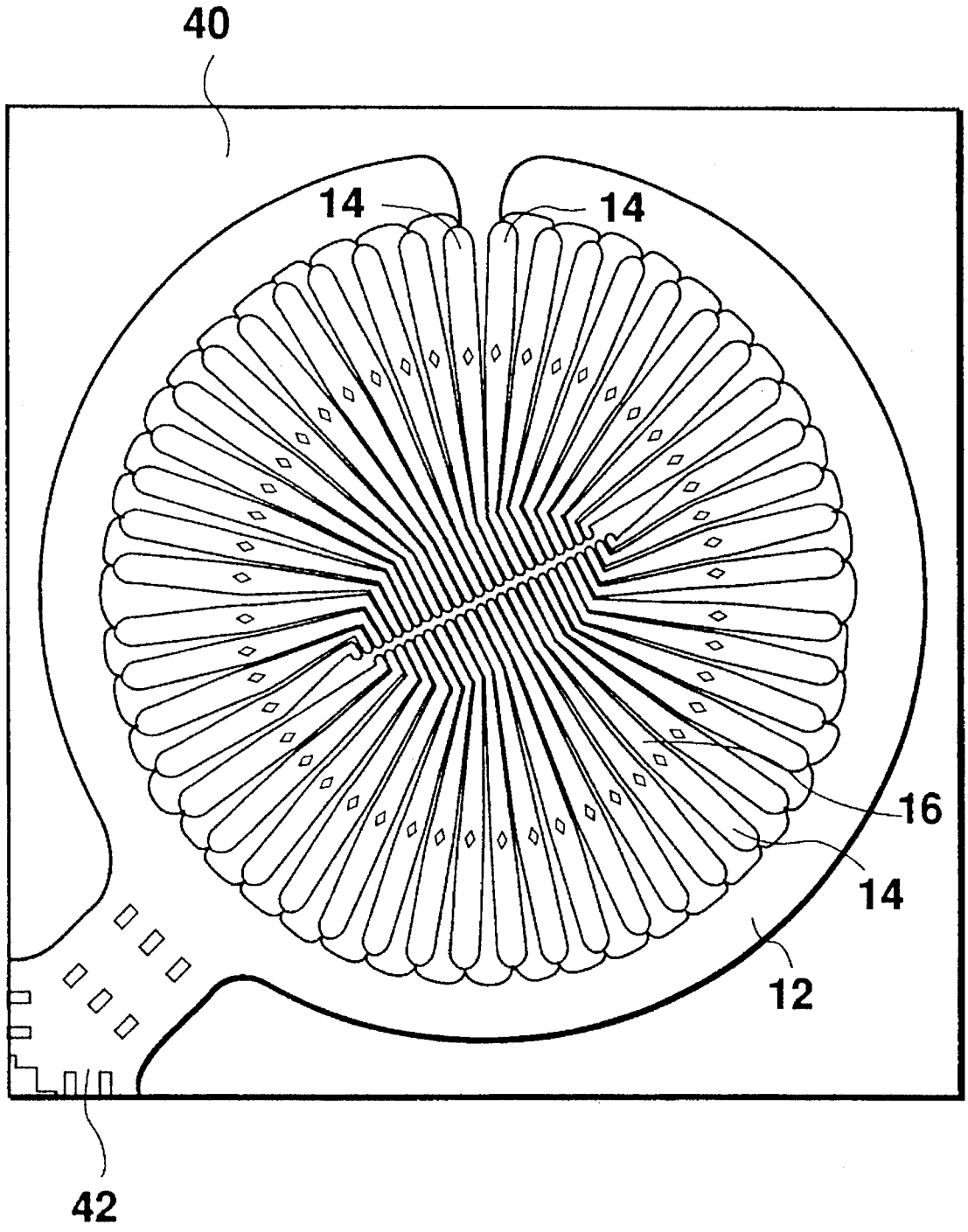
FIG. 12 is a top view of a sixth embodiment of an ink jet print head according to the present invention.
Figure 13:
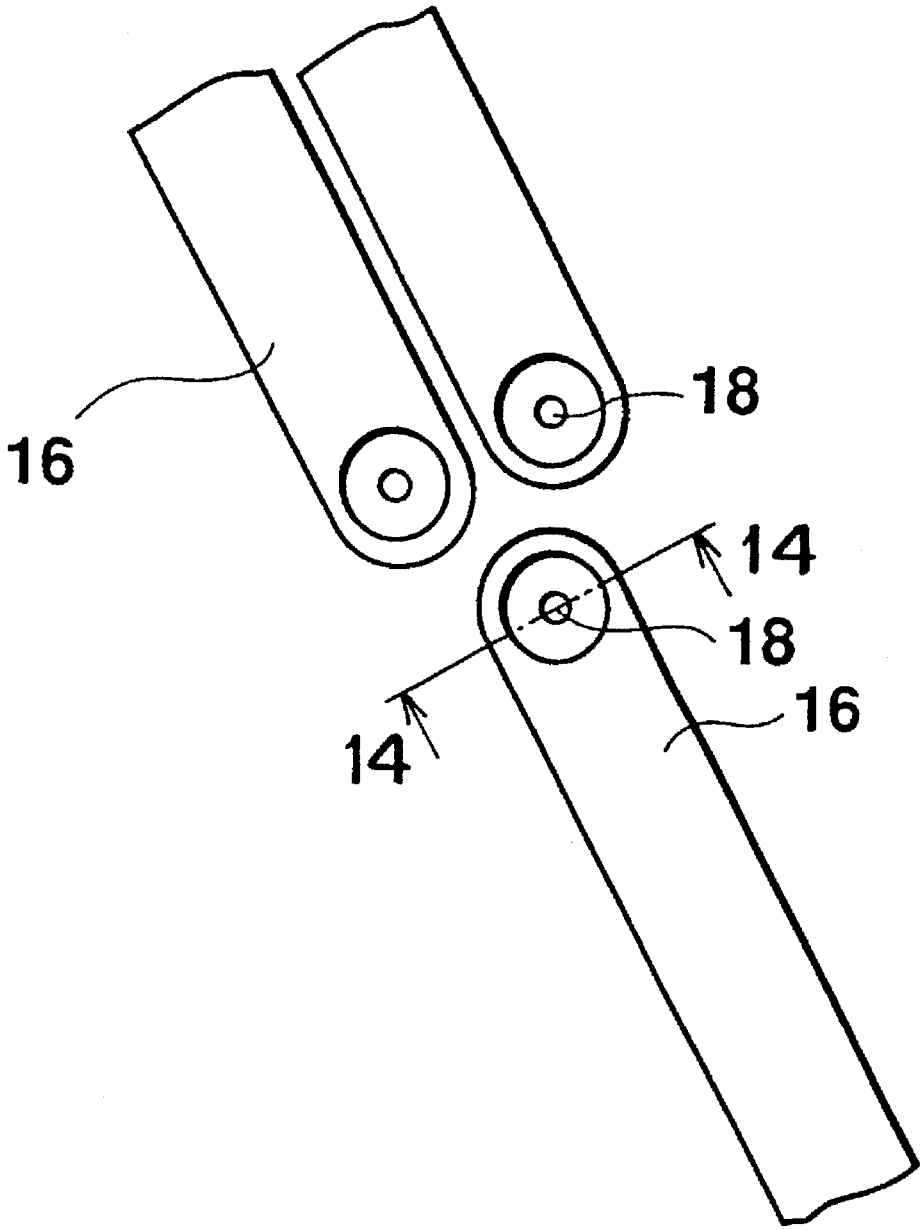
FIG. 13 is an enlarged top view showing a construction near nozzles shown in FIG. 12.

In FIG. 12, there is shown the sixth embodiment of an ink jet print head according to the present invention. FIG. 13 shows an enlarged form near the nozzles 18.

In this embodiment, as shown in FIG. 13, the nozzles 18 are provided in the zig zag arrangement. However, as will be apparent from the comparing of FIG. 12 with FIG. 1 or the like, two straight lines for the zig zag arrangement are given with a certain angle with respect to those shown in FIG. 1. In other words, in FIG. 1, the straight lines are arranged perpendicular to the printing direction, but in FIG. 12, the straight lines are arranged not perpendicular to the printing direction but diagonally across at the certain angle. This arrangement is hereinafter referred to as an inclined zig zag arrangement.

As described above, in this embodiment, since the nozzles 18 are provided in the inclined zig zag arrangement, the interval between the nozzles 18 can be further widened. As a result, the interval between the dots 24 can be narrowed to realize the high printing quality. This effect is more remarkable compared with the first to fourth embodiments. Of course, the other effects obtained in the first embodiment can be also obtained in this embodiment.

Figure 15:
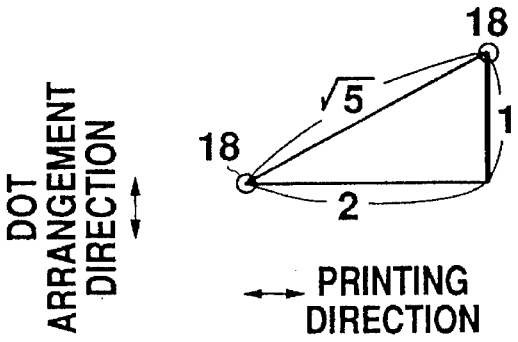
FIG. 15 is a schematic view showing one example of a dimension ratio determination in the ink jet print head shown in FIG. 12.

For example, as shown in FIG. 15, assuming that the inclination of the two straight lines for the inclined zig zag arrangement of the nozzles 18 with respect to the printing direction (head moving direction) is ½, the interval between the two nozzles 18 arranged on the same straight line in the printing direction (left and right hand side direction in FIG. 12) becomes twice the interval of these two nozzles 18 in the dot arrangement direction and down direction in FIG. 12). Hence, the interval between these two nozzles 18 in the print direction becomes $5^{1/2}$ $\{=(1^2+2^2)^{1/2}\}$ times of that in the dot arrangement direction. When the printing is carried out at the density of 360 dot per inch by using the head with such a dimension ratio determination of the sixth embodiment, the interval of the two nozzles 18 arranged on the same straight line becomes as follows:

1 (inch)/360 (dots)×2 (nozzles)×$5^{1/2}$=315 (μm) Thus, even when it is assumed that 50 μm is required for a wall thickness for partitioning the two ink slits 16, the width of each ink slit 16 can be sufficiently wide, for example, 265 μm. In the case of the first embodiment, with the same dimension setting, it is 91 μm. Hence, when the sixth embodiment and the first embodiment are compared with each other in this dimension Setting, the effect of the dot density improvement in the sixth embodiment is approximately three times that in the first embodiment.

Figure 14:
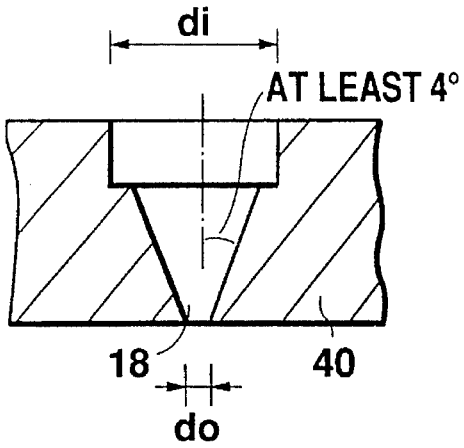
FIG. 14 is a cross sectional view, taken along the line A—A shown in FIG. 13.

As shown in FIG. 14, the nozzles 18 are formed so that the hole may be tapered off at an inclination angle of more than 4°. In order to form the nozzles 18 having such a form by anisotropic etching, for instance, it is sufficient to use the following process. That is, first, a pattern mask is mounted on the surface of a photosensitive glass substrate, and then this photosensitive glass substrate is secured on a work table. Next, the work table is rotated around a predetermined rotary axis. At this time, the work table is inclined at a predetermined angle at the same time. In the state that the work table is rotated and inclined in this manner, the surface of the photosensitive glass substrate, particularly, the portions for forming the nozzles 18 are exposed by an exposure optical system (not shown). Thus, the exposing amount in the periphery of these portions is changed with the passage of time. Since the etching amount of the photosensitive glass substrate is changed depending on the exposure amount, by applying the etching treatment, the nozzles 18 having the tapered form can be formed. By using this method, for example, the nozzles having the tapered form of an inlet dimension (di)/an outlet dimension (do)≧2.5 can be obtained.

When the nozzles 18 with the structure and the dimension as shown in FIG. 14 are designed, since the viscous drag of the ink 60 flowing to the nozzle 18 is reduced, the driving voltage applied to the piezoelectric elements 30 can be lowered and high speed printing can be carried out. This is achieved by the fact that the oscillation of the piezoelectric elements 30 can be damped more quickly.

In general, the viscous drag R can be calculated as follows $$R\ (N{\cdot}s/m^5)=2{\cdot}p{\cdot}L{\cdot}U^2/S^3$$

wherein p: viscosity of ink 60 ($N{\cdot}s/m^5$)

L: length of path of ink 60 (m)

U: peripheral length of cross section of path of ink 60 (m)

S: cross sectional area of path of ink 60 ($m^2$)

When the viscous drag R of the ink 60 at the various portions is calculated by using this formula, the following table is obtained. In this table, the calculated viscous drags R in the sixth embodiment are compared with those in the first embodiment.

TABLE 1

| | First embodiment | Sixth embodiment |
|---|---|---|
| Pressure chamber to | $3.2 \times 10^{11}$ | $1.69 \times 10^{11}$ |
| Nozzle | $3.7 \times 10^{12}$ | $2.39 \times 10^{12}$ |
| Whole | $4.0$ ' $10^{12}$ | $2.56 \times 10^{12}$ |

As is apparent from Table 1, in this embodiment, the viscous drag R is remarkably reduced to approximately ½. In this case, as p and L, typical values are used, and as U and S, the values used in comparing the width of the ink slit 16 are used.

Also, as to the substrate for the head, one having a thickness of 0.5 mm or 1.0 mm has been heretofore used as standard. When the substrate 40 having this thickness is used in the first or fifth embodiment, assuming that the depth of the ink slits 16 is determined to, for example, 0.1 mm, the depth of the nozzles 18 is 0.4 mm or 0.9 mm. Since a large viscous drag R is given at the discharging time of the ink 60, in particular, the thickness of the substrate 40 must be thinned. This has been heretofore used as the reduction method of the viscous drag R. In this embodiment, the viscous drag R can be reduced without using this method. Hence, even when the dot density is increased, it is unnecessary to reduce the thickness of the substrate 40, and as a result, it becomes unlikely that the vibration of one piezoelectric element 30 will affect other piezoelectric elements. From this viewpoint, the high speed printing with high accuracy can be carried out.

Further, similar to the first to fourth embodiments, in this embodiment, the mounting structure of the fifth embodiment can be combined. Also, in this embodiment, the piezoelectric elements 30 described in the first, third or fourth embodiment can be used, and thus the detailed description thereof can be omitted for brevity. Further, in the same manner as the second embodiment, the nozzles 18 can be separated into a plurality of groups. When this embodiment is combined with the other embodiments, of course, the effects of the other embodiments can be obtained.

The seventh embodiment

Figure 16:
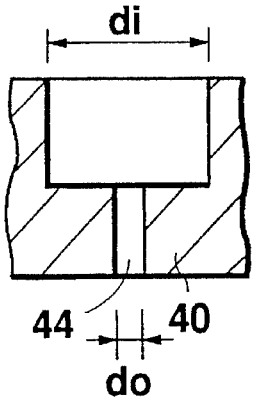
FIG. 16 is a cross sectional view of a nozzle of a seventh embodiment of an ink jet print head according to the present invention.

In FIG. 16, there is shown a cross section of a nozzle 18 of the seventh embodiment of an ink jet print head according to the present invention. The other parts of the ink jet print head can be the same as those of the first to sixth embodiments.

In this embodiment, as shown in FIG. 16, the form of the bore of the nozzle 44 is different from that in the sixth embodiment. That is, the internal diameter of the bore of the nozzle 44 is stepwise changed. In this case, for example, the outlet dimension do of the nozzle 44 is determined to at least ⅓ of the inlet dimension di.

In this embodiment, the same effects as those of the sixth embodiment can be obtained. The viscous drag R is calculated in the same manner as the sixth embodiment, and the results are shown in the following table. As is apparent from this table, the reduction effect of the viscous drag R is more remarkable than the sixth embodiment, and the viscous drag R can be reduced to approximately ⅓ of the first embodiment.

TABLE 2

| | First embodiment | Seventh embodiment |
|---|---|---|
| Presure chamber to nozzle | $3.2 \times 10^{11}$ | $1.73 \times 10^{11}$ |
| Nozzle | $3.7 \times 10^{12}$ | $1.19 \times 10^{12}$ |
| Whole | $4.0 \times 10^{12}$ | $1.36 \times 10^{12}$ |

Further, similar to the first to fourth embodiments, in this embodiment, the mounting Structure of the fifth embodiment can be combined. Also, in this embodiment, the piezoelectric elements 30 described in the first, third or fourth embodiment can be used, and thus the detailed description thereof can be omitted for brevity. Further, in the same manner as the second embodiment, the nozzles 44 can be separated into a plurality of groups. When this embodiment is combined with the other embodiments, of course, the effects of the other embodiments can be also obtained. In this embodiment, the effect of the dot density improvement to the same extent as the sixth embodiment can be obtained.

The eighth embodiment

Figure 17:
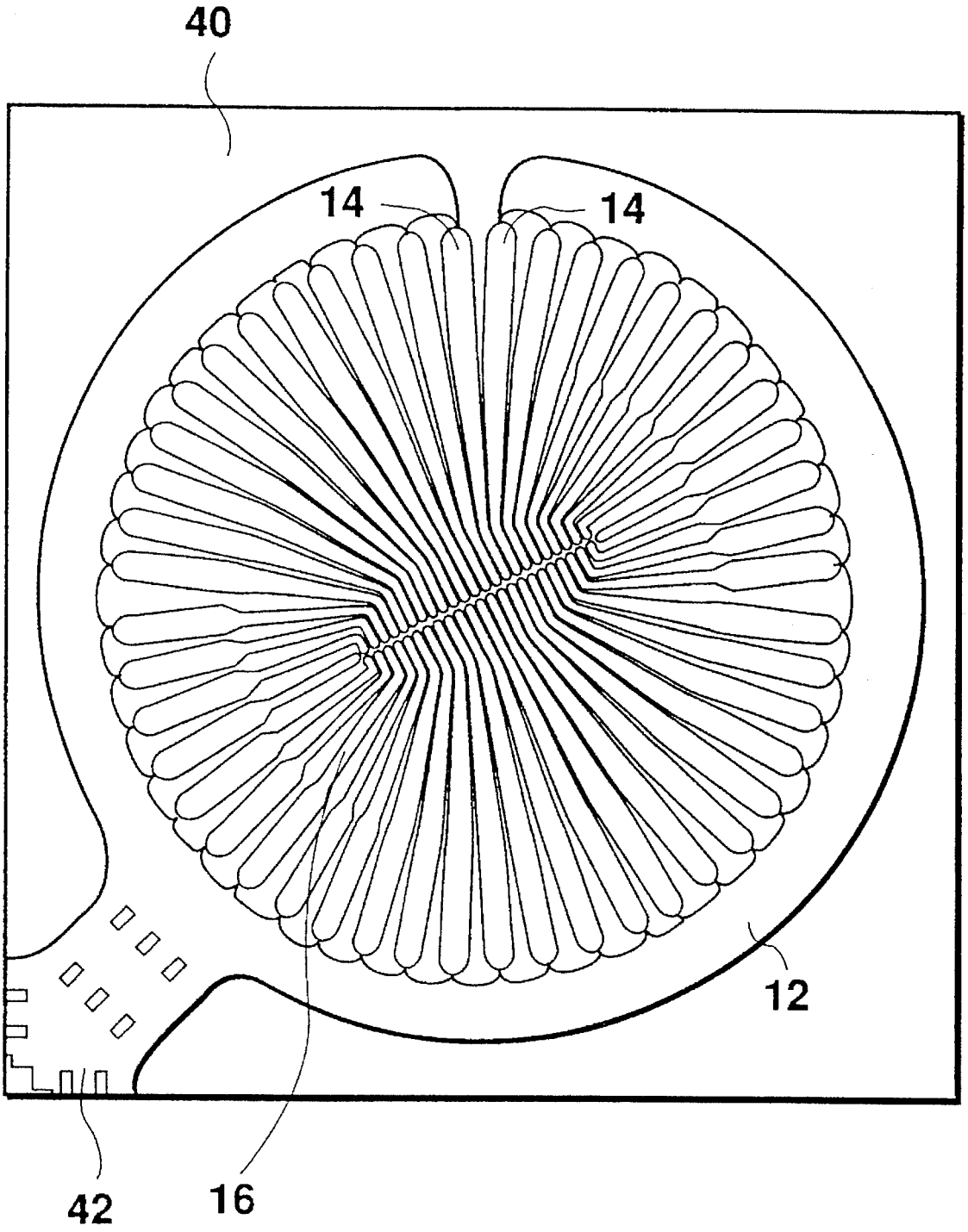
FIG. 17 is a top view of an eighth embodiment of an ink jet print head according to the present invention.

In FIG. 17, there is shown the eighth embodiment of an ink jet print head according to the present invention.

In this embodiment, compared with the seventh embodiment, the shapes of the pressure chambers 14 and the ink slits 16 are designed so that the viscous drags of the ink 60 flowing from the respective pressure chambers 14 to the respective nozzles 18 may be equal to each other. More specifically, for the nozzle 18 connected to the ink slit 16 having a relatively short length, that is, the nozzle 18 positioned in the end part of the inclined zig zag arrangement, the peripheral length of this ink slit 16 is determined to be relatively small, and for the nozzle 18 connected to the ink slit 16 having a relatively long length, that is, the nozzle 18 positioned in the central part of the inclined zig zag arrangement, the peripheral length of this ink slit 16 is determined to be relatively large. As a result, the ink slits 16 are somewhat inclined with respect to the straight lines on which the nozzles 18 are arranged. In this case, regardless of the positions of the inclined zig zag arrangement, the ink discharge properties of the nozzles 18 can be mutually equalized.

In this embodiment, the effects obtained in the seventh embodiment can also be achieved. Also, similar to the first to fourth embodiments, in this embodiment, the mounting structure of the fifth embodiment can be combined. Also, in this embodiment, the piezoelectric elements 30 described in the first, third or fourth embodiment can be used, and thus the detailed description thereof can be omitted for brevity. Further, in the same manner as the second embodiment, the nozzles 18 can be separated into a plurality of groups. When this embodiment is combined with the other embodiments, of course, the effects of the other embodiments can also be obtained.

The ninth embodiment

Figure 18:
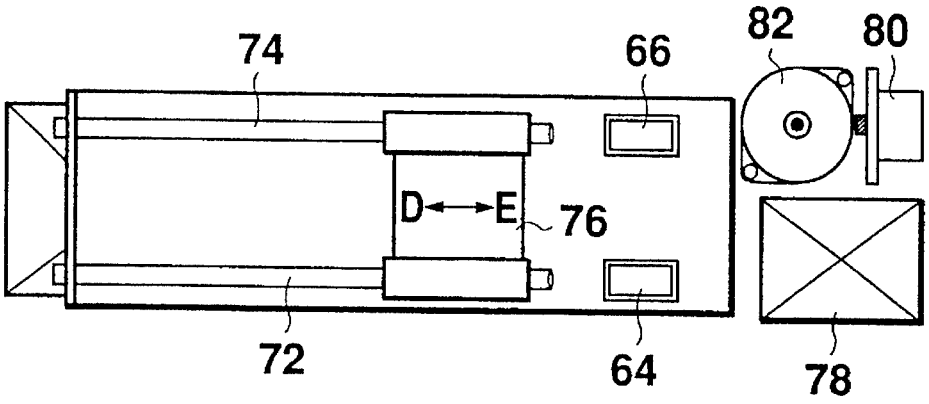
FIG. 18 is a top view of an essential part of a ninth embodiment of an ink jet printer according to the present invention.
Figure 19:
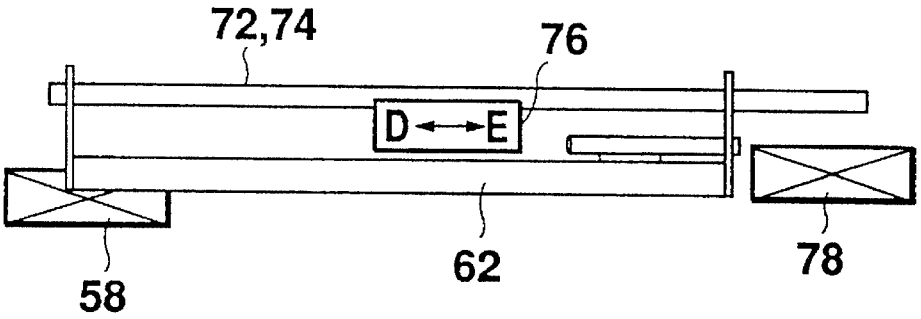
FIG. 19 is an elevational view of an essential part of the ink jet printer shown in FIG. 18.
Figure 20:
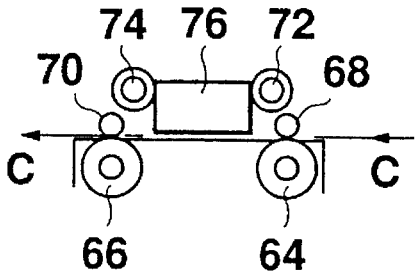
FIG. 20 is a side view of an essential part of the ink jet printer shown in FIG. 18.

In FIGS. 18 to 20, there is shown the ninth embodiment according to the present invention, that is, a whole structure of an ink jet printer constructed by using the structures of the aforementioned embodiments. FIG. 18 is a top view, FIG. 19 is a front view, and FIG. 20 is a side view.

First, a platen 62 is constructed as a flat platen so as to miniaturize and thin the whole size and to obtain a shape and dimension adaptable to a facsimile, plotter, bar code printer or the like. A printing medium is fed to the platen 62 in a direction indicated by arrows C shown in FIG. 20.

Further, in order to achieve a correct feeding of the printing medium, feed rollers 64 and 66 are provided at the front and rear sides of the platen 62. The feed rollers 64 and 66 together with idle rollers 68 and 70 facing the respective feed rollers 64 and 66 hold the printing medium between the two rollers so as to move forward the same. A pair of carriage guides 72 and 74 are provided above the platen 62.

A carriage 76 is slidably mounted on the carriage guides 72 and 74 so as to move in a D–E direction. A driving system (not shown) including a stepping motor or another driving means is connected to the carriage 76 so as to move the carriage 76 to any position in the row direction with respect to a recording medium. Hence, the carriage 76 can be moved in both the directions along the D–E direction by this driving force.

The head of one of the first to eighth embodiments described above is built in the carriage 76 so as to direct to the printing medium introduced on the platen 62. The ink fountain 58 for supplying the ink to the head is mounted below the platen 62. The ink fountain 58 and the ink introducing aperture 42 of the head are coupled by, for example, a flexible pipe 57 (not shown).

Further, in order to prevent solidification of the ink 60 in the nozzles 18 when the nozzles 18 are not used, a cleaning unit 78 is also provided. When no printing is executed, the carriage 76 is retracted so that the head may face to the cleaning unit 78.

A feed motor 80 gives the driving force for the movement of the recording paper and the cleaning unit 78. Also, a carriage motor 82 for driving the carriage 76 is mounted. In FIGS. 18 to 20, driving force transmission mechanisms for coupling the feed motor 80 and the carriage motor 82 with the objects to be driven are not shown, but any conventional means can be properly used.

The tenth embodiment

Figure 21:
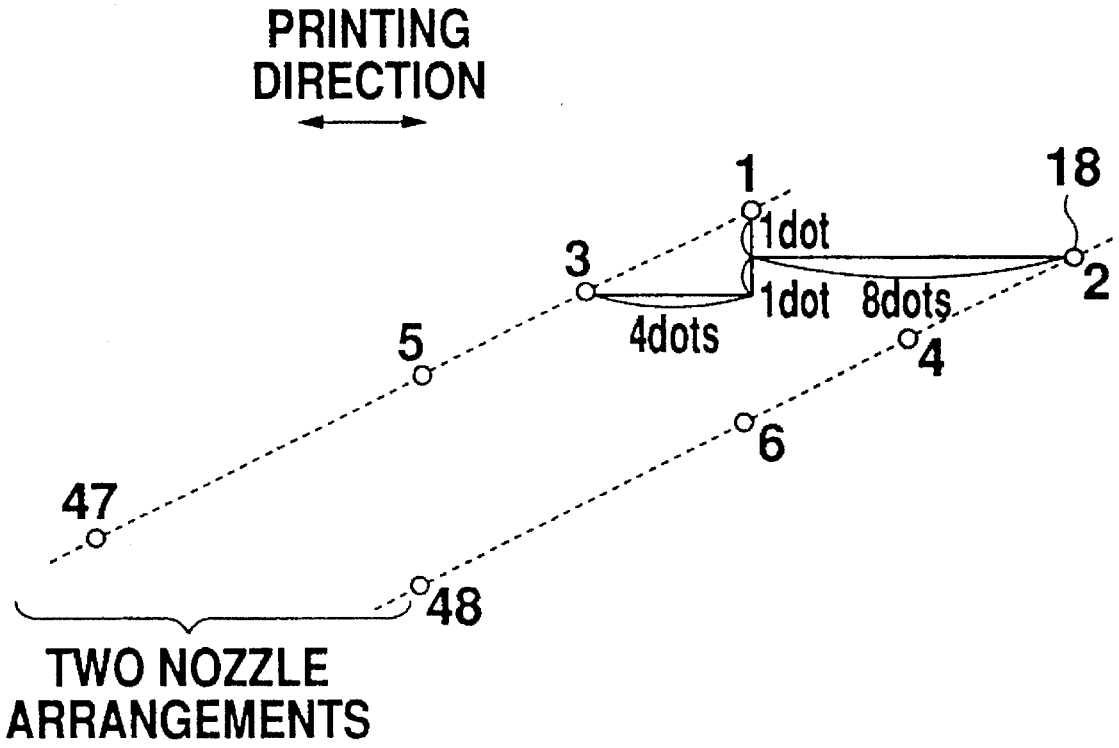
FIG. 21 is a schematic view showing an inclined zig zag arrangement in a tenth embodiment of an ink jet print head according to the present invention.

In FIG. 21, there is shown an arrangement of nozzles used in the tenth embodiment of an ink jet print head according to the present invention. In this embodiment, as shown in FIG. 21, a head including an inclined zig zag arrangement of the nozzles is used in the same manner as the sixth to eighth embodiments.

In this embodiment, as shown in FIG. 21, the nozzles 18 are arranged on two straight lines extending in a direction not perpendicular to the head moving direction (printing direction) but intersecting the same at a predetermined angle, as shown by two broken lines in FIG. 21. Also, the nozzles 18 (with odd numbers) arranged on one straight line are offset with respect to the nozzles 18 (with even numbers) arranged on another straight line in the direction perpendicular to the printing direction. In this embodiment, for example, the first nozzle 18 is offset with respect to the second nozzle 18 by 8 dots in the printing direction and by one dot in the direction perpendicular to the printing direction. Also, the two adjacent nozzles 18 arranged on the same straight line are separated from each other by 4 dots in the printing direction and by 2 dots in the direction perpendicular to the printing direction. Such an inclined zig zag arrangement makes the interval between the nozzles 18 in the direction perpendicular to the printing direction narrow and enables the higher definition printing.

When the head of the inclined zig zag arrangement is driven, it is not enough to simply apply the driver circuit of the thermal head, as described above, that is, to change only the output parts.

More specifically, in FIG. 35, prior to inputting into a shift register 25, it is necessary to properly apply preprocessing to the serial data. For example, it is assumed that the outputs OUT1 to OUT48 shown in FIG. 35 are allocated to the nozzles 18 with numbers 1 to 48 in FIG. 21. In this case, the data to be used for driving the nozzles 18 arranged on one straight line of the front in the printing direction must be delayed by 8 lines with respect to the data to be used for printing by the nozzles 18 arranged on another straight line of the rear in the printing direction. Also, relating to the nozzles 18 arranged on the same straight line, since the printing direction positions of the nozzles 18 are different from each other, the data of the different time point should be for each nozzle 18, that is, each bit of the input serial data. The above-described preprocessing concerns the operation of the order of the bit data and the like.

In the tenth embodiment described hereinafter, the necessity of the above-described preprocessing by an external controller, CPU or the like can be removed, and by supplying only the serial data of the same contents as those shown in FIGS. 33 and 34 to the ink jet print head driver circuit, the printing by using the head of the inclined zig zag arrangement can be properly executed. As means for carrying out this, hardware for performing preprocessing is added to an ink jet print head driver circuit. The tenth embodiment will now be described with reference to FIGS. 22 to 31.

Figure 22:
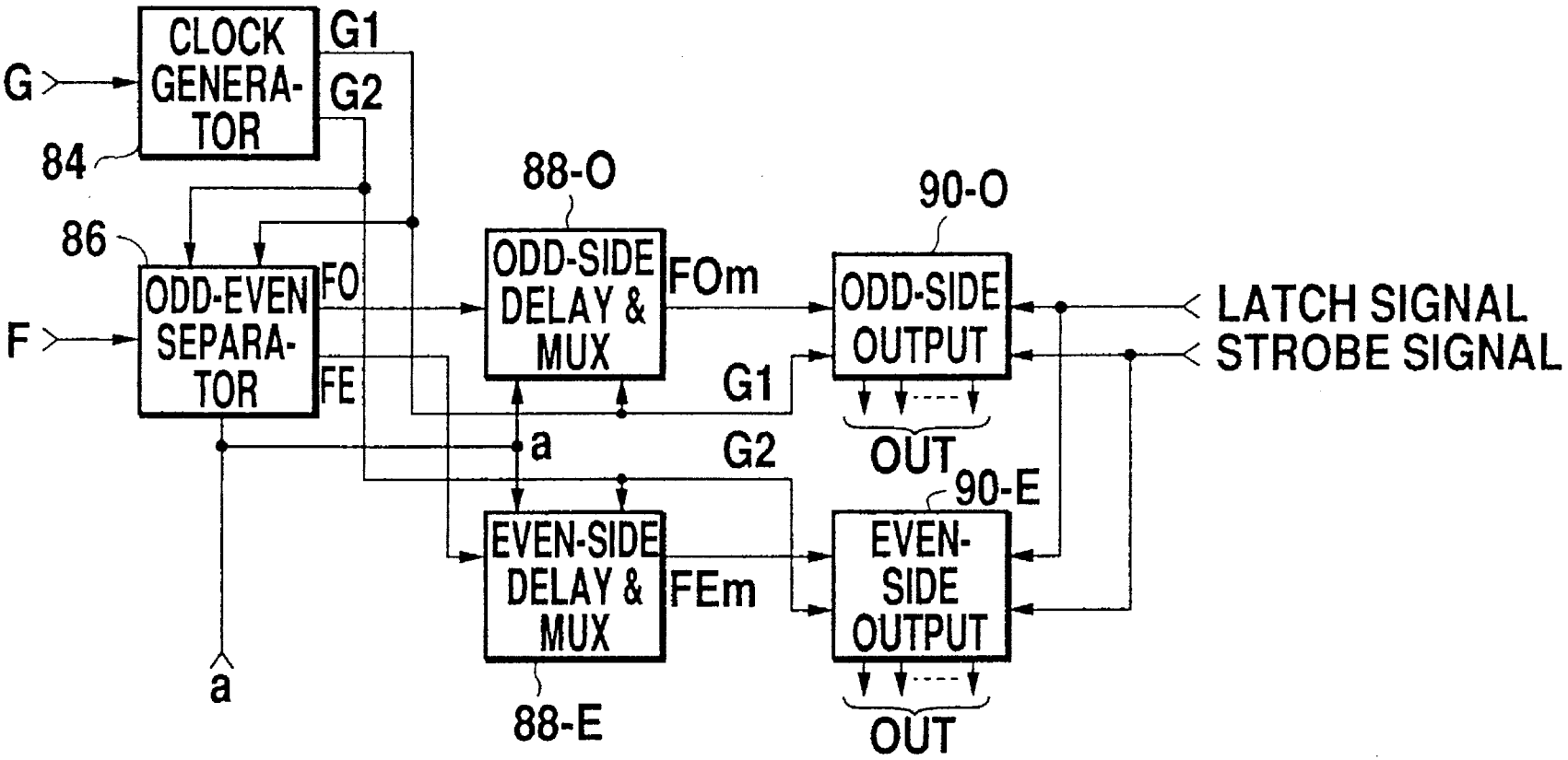
FIG. 22 is a block diagram of a driver circuit of the tenth embodiment of the ink jet print head according to the present invention.

In FIG. 22, there is shown the whole circuit construction of an ink jet print head driver circuit of the tenth embodiment according to the present invention. This driver circuit is comprised of a clock generator 84, an odd-even separator 86, an odd-side delay & multiplexer (MUX) 88-0, an even-side delay & multiplexer 88-E, an odd-side (nozzle data) output circuit 90-0 and an even-side (nozzle data) output circuit 90-E. This driver circuit drives the head having the nozzles 18 arranged in the inclined zig zag arrangement shown in FIG. 21. Also, the driver circuit shown in FIG. 22 is implemented as an IC or an LSI. In this case, serial data F, a clock G, a printing direction signal a for exhibiting the head moving direction (printing direction), a latch signal and a strobe signal are input to the driver circuit from the outside, and the driver circuit outputs signals OUT1 to OUT48 for the piezoelectric elements 30 of a certain number (=48) of dots.

In this embodiment, the head of the inclined zig zag arrangement can be driven by inputting the similar data F and clock G as those of the circuit shown in FIG. 35 except the printing direction signal a because the preprocessing for dealing with the inclined zig zag arrangement is carried out in the driver circuit. By employing this construction, there is no need to previously apply processing such as an order operation and the like to the serial data F to be supplied, and the same usability as that using the head having the nozzles arranged on one vertical straight line can be maintained. Further, since the head of the inclined zig zag arrangement is used, the density of the dots 24 can be raised.

Next, the parts of the driver circuit in this embodiment will now be described in detail. As will be apparent from the following description, the driver circuit can be readily constructed by using one IC, and hence a reduction of a substrate occupied area and a low production cost can be realized.

Figure 23:
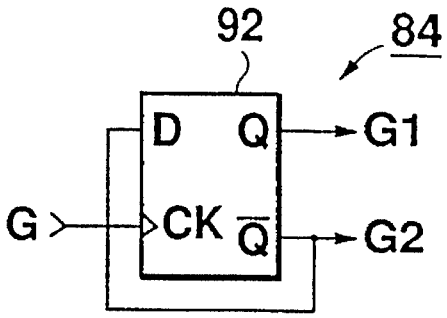
FIG. 23 is a block diagram of a clock generator shown in FIG. 22.

First, as shown in FIG. 23, the clock generator 84 is comprised of a D type flip-flop 92. In the D type flip-flop 92, a $\overline{Q}$ output is fed back to a D input, and the clock G is input to the CK terminal. Hence, when the clock G rises, the Q output and the $\overline{Q}$ output are inverted, and signals G1 and G2 obtained as the Q output and the $\overline{Q}$ output become clocks obtained by two-dividing of the clock G. Thus, the clock G2 and the clock G1 become opposite phases. As described hereinafter, since the clock G1 is used for separating the data concerning the odd number nozzle from the serial data F, the clock G1 is hereinafter referred to as an odd-side clock. Similarly, the clock G2 is used for separating the data concerning the even number nozzle from the serial data F, the clock G2 is hereinafter referred to as an even-side clock.

Figure 24:
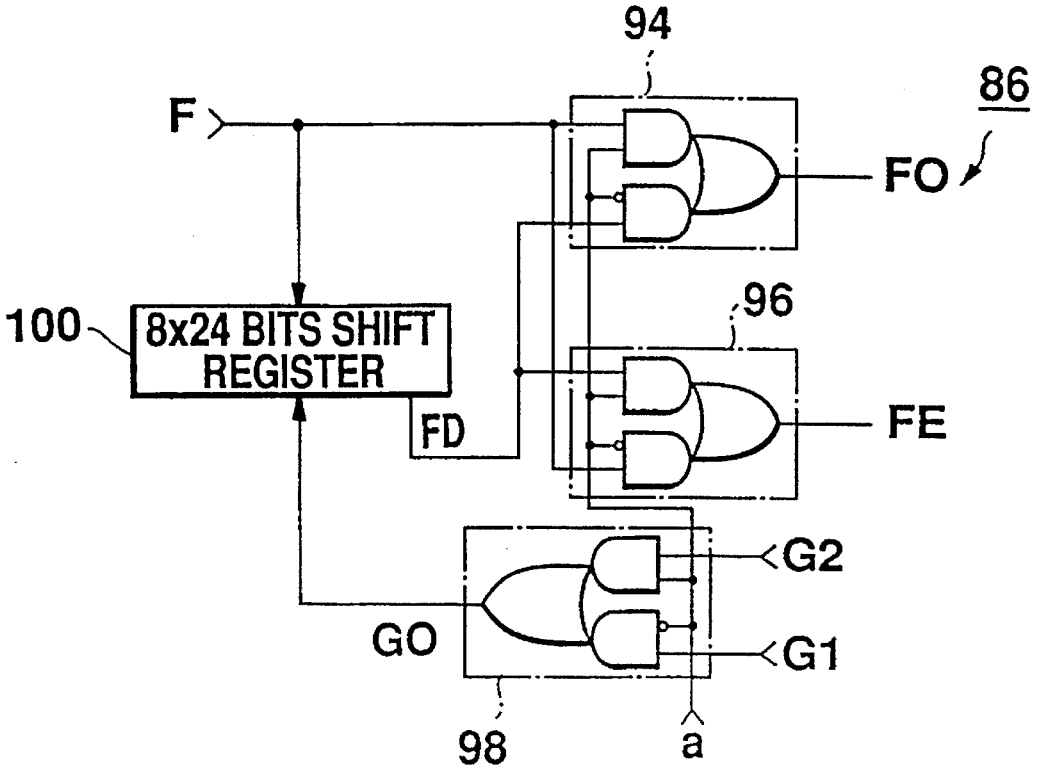
FIG. 24 is a block diagram of an odd-even separator shown in FIG. 22.

As shown in FIG. 24, the odd-even separator 86 is comprised of output gates 94 and 96, a clock selecting gate 98 and a shift register 100. The output gate 94 outputs either the data F or data FD as odd-side data FO when the printing direction signal a is H or L. The output gate 96 outputs either the data FD or the data F as even-side data FE when the printing direction signal a is H or L. The clock selecting gate 98 outputs either the even-side clock G2 or the odd-side clock G1 as a shift clock GO when the printing direction signal a is H or L. The shift register 100 shifts the data F every one bit at the timing of the shift clock GO and outputs the data FD shifted 8×24 bits (=8 lines).

In this case, the data F0 and FE obtained in the odd-even separator 86 are called the odd-side data and the even-side data, respectively, because, when these data are latched at the timing of the odd-side clock G1 or the even-side clock G2, data concerning the odd number or even number nozzle 18 (hereinafter referred to as odd-nozzle data FOm and even-nozzle data FEm, respectively) are extracted.

When the printing direction signal a=H, the odd-side data FO are the data F, and the even-side data FE are the data FD obtained by delaying the data F 8×24 bits. At this time, since the data FD are obtained by the shifting operation by using the even-side clock G2 in the shift register 100, their contents are the even-nozzle data. In turn, when the printing direction signal a=L, the odd-side data FO are the data FD, and the even-side data FE are the data F. At this time, since the data FD are obtained by the shifting operation by using the odd-side clock G1, their contents are the odd-nozzle data.

Further, in the shift register 100, the 8×24 bits of shift is carried out. This means that the data FD are delayed by 8 lines compared with the data F. That is, since the nozzles 18 are arranged in the inclined zig zag arrangement, as shown in FIG. 21, and the numbers of the nozzles 18 arranged on the two straight lines are 24, by the 8×24 bits of shift, 8 lines are delayed. In this case, the line is the arrangement of the dots 24 in the direction perpendicular to the printing direction.

Figure 25:
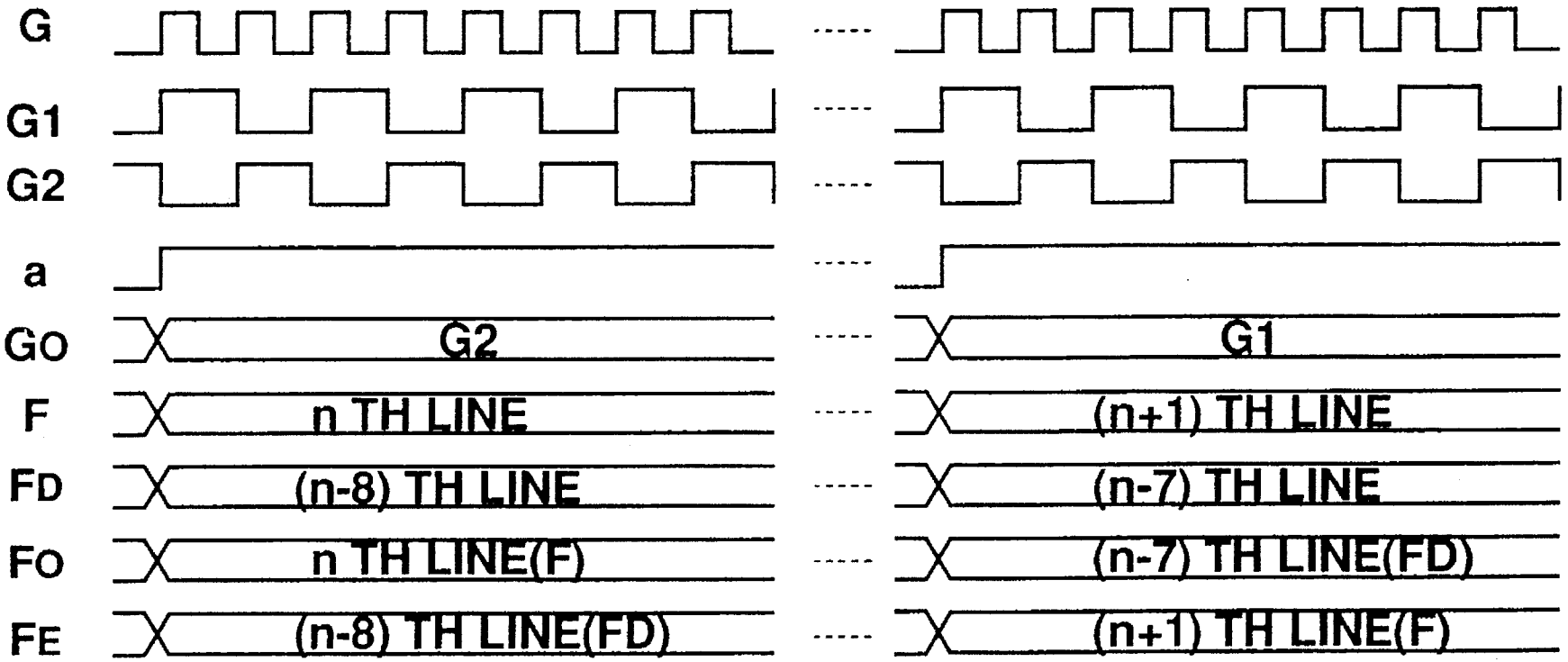
FIG. 25 is a timing chart showing an operation of the clock generator and the odd-even separator shown in FIG. 22.

Therefore, the data FO and FE output from the odd-even separator 86 have the contents Shown in FIG. 25. First, when the printing direction signal a=H and an n-th line of data as the data F are input, the odd-side data FO become the n-th line of data F and the even-side data FE become an (n−8)th line of data FD of 8 lines older than the data F. Next, when the printing direction signal a=L and the (n+1)th line of data as the data F are input, the odd-side data FO become an (n−7)th line of data FD and the even-side data FE become the (n+1)th line of data F of 8 lines newer than the data FD.

These odd-side and even-side data FO and FE having such contents along with the odd-side clock G1 and the even-side clock G2 are input to the odd-side delay & multiplexer 88-0 and the even-side delay & multiplexer 88-E, respectively.

Figure 26:
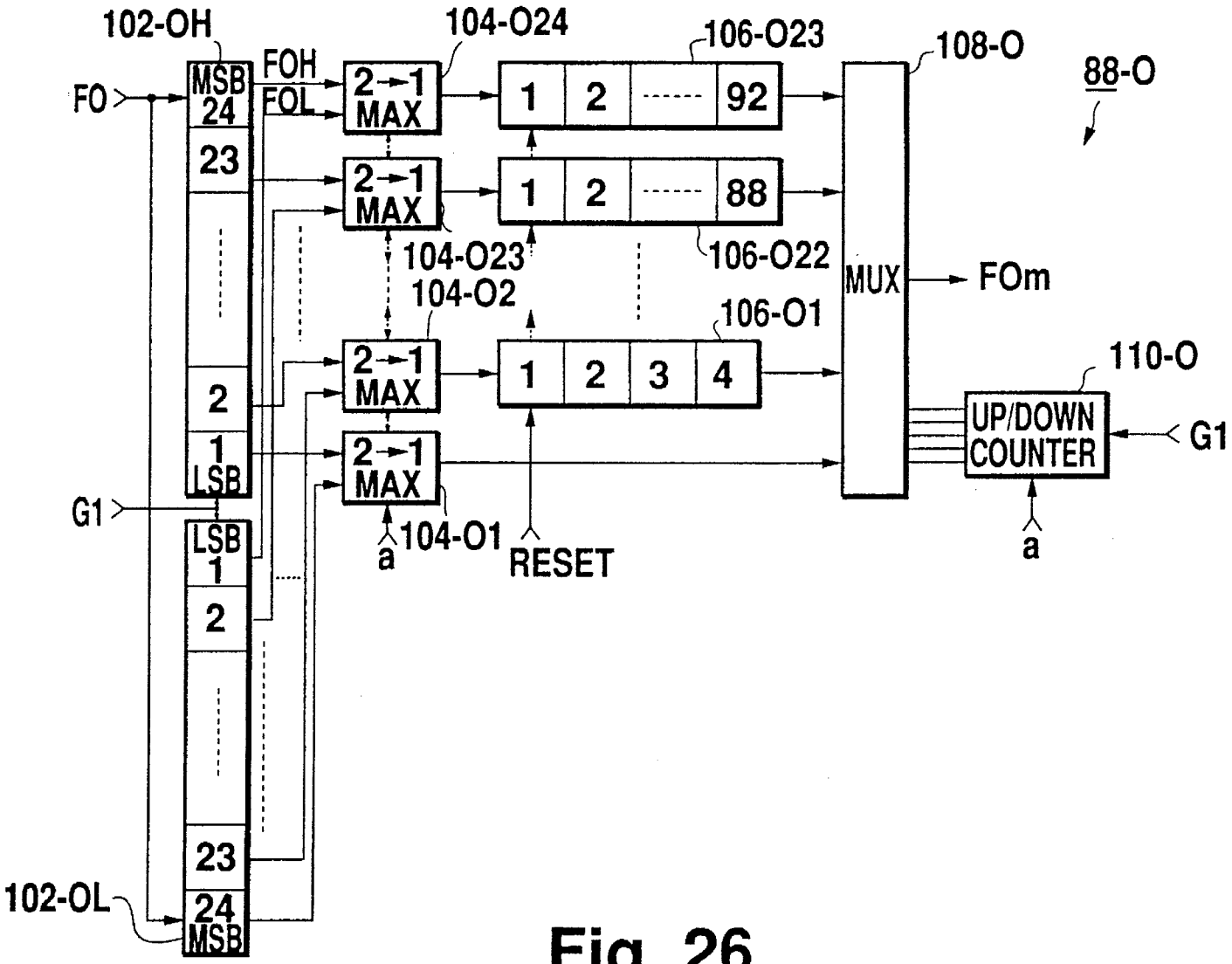
FIG. 26 is a block diagram of an odd-side delay & multiplexer (MUX) shown in FIG. 22.
Figure 27:
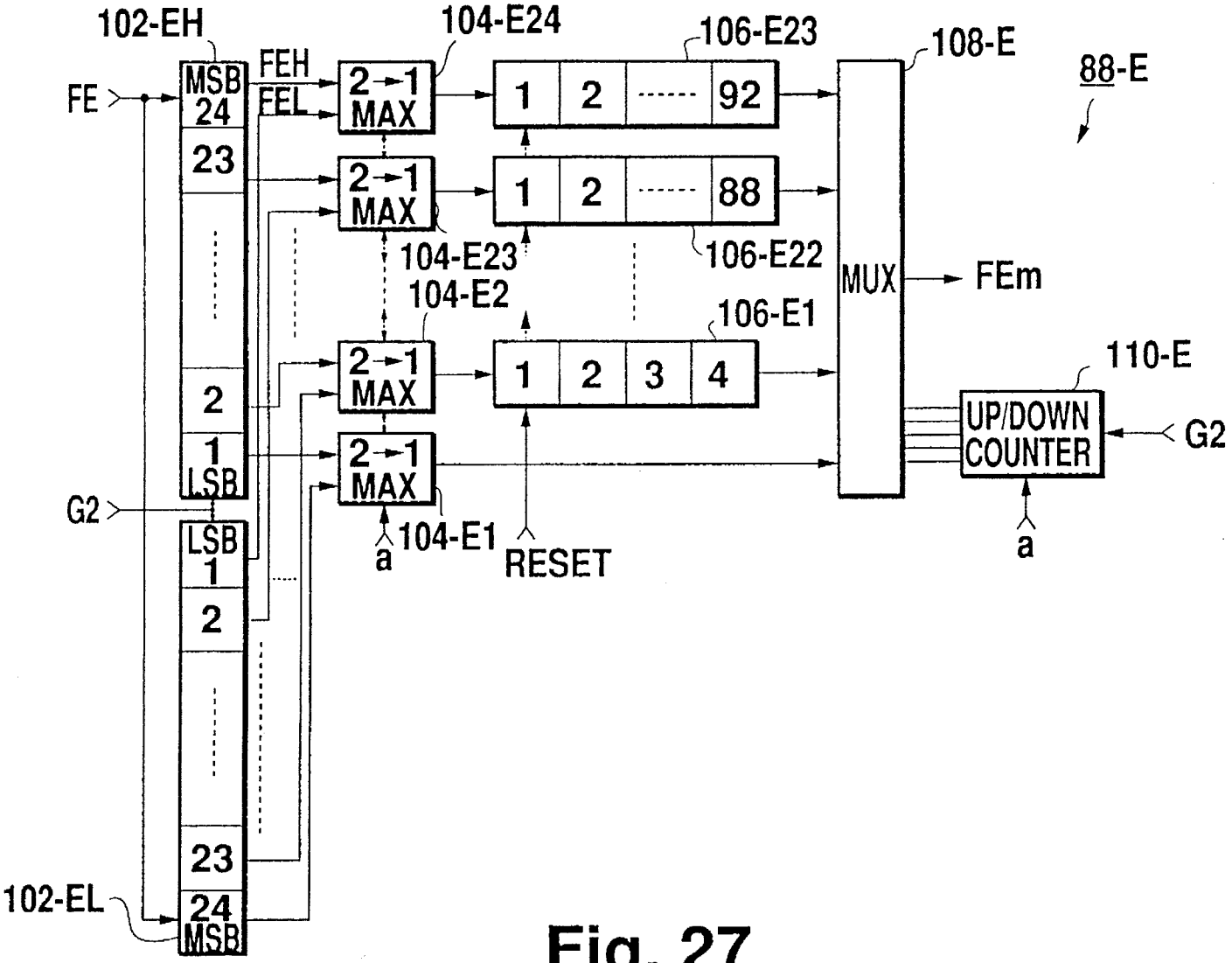
FIG. 27 is a block diagram of an even-side delay & multiplexer shown in FIG. 22.

In FIGS. 26 and 27, there are shown the odd-side delay & multiplexer 88-0 and the even-side delay & multiplexer 88-E, respectively.

The odd-side delay & multiplexer 88-0 is comprised of shift registers 102-OH and 102-OL, multiplexers 104-01 to 104-024, shift registers 106-01 to 106-023, a multiplexer 108-0 and an up/down counter 110-0. Similarly, the even-side delay & multiplexer 88-E is comprised of shift registers 102-EH and 102-EL, multiplexers 104-El to 104-E24, shift registers 106-El to 106-E23, a multiplexer 108-E and an up/down counter 110-E. The differences between the odd-side delay & multiplexer 88-0 and the even-side delay & multiplexer 88-E are as follows. First, the data to be processed are the odd-side data FO and the even-side data FE. Second, the clocks used for the processings are the odd-side clock G1 and the even-side clock G2. Third, the output data are the odd-nozzle data FOm and the even-nozzle data FEm. Except for these differences, the odd-side delay & multiplexer 88-0 and the even-side delay & multiplexer 88-E have almost the same internal construction and processing function. Hence, in this embodiment, only the odd-side delay & multiplexer 88-0 will be described, and the description of the even-side delay & multiplexer 88-E can be omitted for brevity.

In FIG. 26, the odd-side data FO separated from the input data F in the odd-even separator 86 are input to the 24 bits of shift registers 102-0H and 102-0L. The shift register 102-0H shifts the input odd-side data FO at the timing of the odd-side clock G1 to generate odd number nozzle data FOH. That is, the odd-side data FO output from the odd-even separator 86 are latched by the shift register 102-OH at the timing of the odd-side clock G1 to generate the odd number nozzle data FOH. Similarly, the shift register 102-OL shifts the input odd-side data FO at the timing of the odd-side clock Gi to generate odd number nozzle data FOL.

Hence, the odd number nozzle data FOH and FOL generated by the respective shift registers 102-OH and 102-OL become one line (24 bits on only odd-side) of data of the same contents. However, the odd number nozzle data FOH and the odd number nozzle data FOL are fed to different parts. More specifically, the odd number nozzle data FOH, such as the 24th bit to the multiplexer 104-024, the 23th bit to the multiplexer 104-023, . . . , and the first bit to the multiplexer 104-01, are allocated to the targets in order of the shift bit number increase. On the other hand, the odd number nozzle data FOL, such as the first bit to the multiplexer 104-024, the second bit to the multiplexer 104-023, . . . , and the 24th bit to the multiplexer 104-01, are allocated to the targets in order of the shift bit number decrease. In other words, the odd number nozzle data FOH and FOL to be supplied to the multiplexers 104-01 to 104-024 are the data whose bit orders are mutually inverted.

In this case, the multiplexers 104-01 to 104-024 are 2 to 1 multiplexers and thus function as selectors. The multiplexers 104-01 to 104-024 select and output either the odd number nozzle data FOH or FOL when the printing direction signal a is H or L. The bits output from the multiplexer 104-024 are shifted by 4×(24−1)=92 bits in the shift register 106-023 of its rear stage, and the bits output from the multiplexer 104-023 are shifted by 4×(24−2)=88 bits in the shift register 106-022. In this manner, the outputs of the multiplexers 104-02 to 104-024 are shifted by (4×dot position) of bits in the shift registers 106-01 to 106-023. The output of the multiplexer 104-01 is not shifted. The outputs of the shift registers 106-01 to 106-023 and the output of the multiplexer 104-01 are input to the multiplexer 108-0. In this case, the shift registers 106-01 to 106-023 are reset at the operation start time and the printing direction reverse time.

Thus, the odd number nozzle data shifted by the different bit numbers every bit are multiplexed by the multiplexer 108-0 to convert into the serial data FOm of the equal rate to the odd-side clock G1. The multiplexing direction in the multiplexer 108-0 is determined by the outputs of the up/down counter 110-0. The up/down counter 110-0 counts the odd-side clock G1 either up to 24 or down to 0 when the printing direction signal a is H or L. As a result, when the printing direction signal a is H, the counted result is input to the multiplexer 108-0 in order of 1, 2, 3, . . . and 24, and, when the printing direction signal a is L, the counted result is input in reverse order. The multiplexer 108-0 selects and outputs the bit data of the output of the multiplexer 104-01 and the outputs of the shift registers 106-01 to 106-023 depending on the counted result of the up/down counter 110-0. For example, when the counted result input from the up/down counter 110-0 is 1, the multiplexer 108-0 selects the output of the multiplexer 104-01 and outputs the selected output, and, when the counted result of the up/down counter 110-0 is 2, the multiplexer 108-0 selects the Output of the shift register 106-01. Accordingly, the multi plexing order by the multiplexer 108-0 is changed depending on the printing direction.

Figure 28:
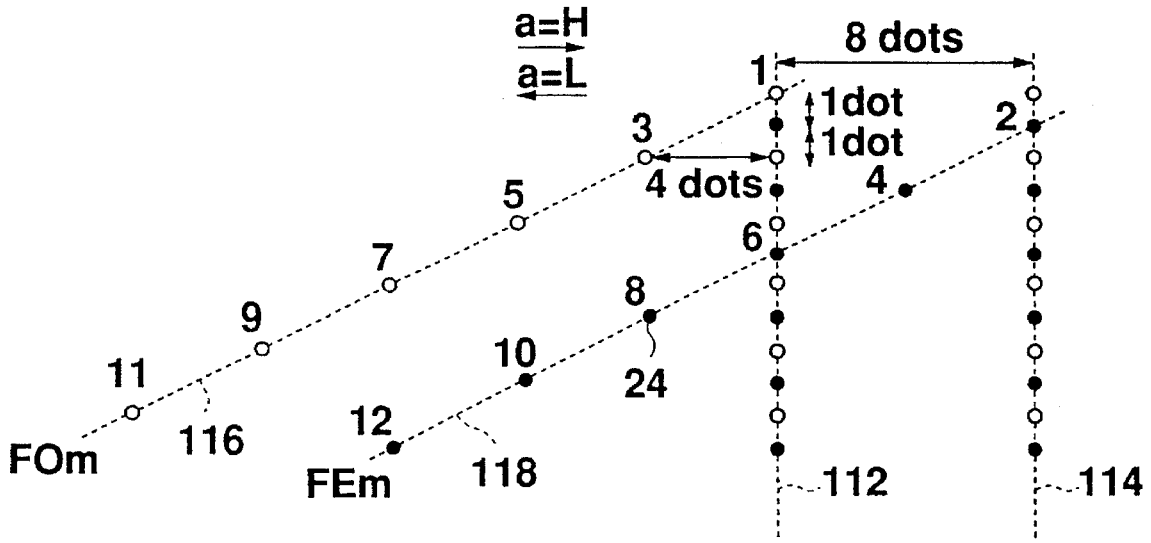
FIG. 28 is a schematic view showing an operation of the odd-side delay & multiplexer and the even-side delay & multiplexer shown in FIG. 22.

FIG. 28 shows the meaning of the operation of the odd-side delay & multiplexer 88-0 and the even-side delay & multiplexer 88-E.

First, when the data are expressed as the positions of the dots 24, the odd-side data FO output from the odd-even separator 86 include the bit at a corresponding to the dots 24 on a straight line shown by a broken line 112. Similarly, the even-side data FE output from the odd-even separator 86 include the bit data corresponding to the dots 24 on a straight line shown by a broken line 114. The line 112 of the odd-side data FO and the line 114 of the even-side data FE are separated by, 8 lines, and this interval is obtained by the delay processing in the odd-even separator 86.

The nozzles 18 have the inclined zig zag arrangement shown in FIG. 21, as described above. In this arrangement, the printing direction interval between the two lines of nozzle arrangement is equivalent to 8 dots. Hence, when the printing from the left hand sine to the right hand side is executed, the odd-side data FO of the line 112 should be 8 lines older than the even-side data FE of the line 114, and in the opposite case, the even-side data FE should be 8 lines older than the odd-side data FO. The above-described 8 lines delay principle in the odd-even separator 86 is used for adapting the printing control to the geometrical relationship between the arrangement lines of the nozzles 18.

Further, in the odd-even separator 86, the target of the 8 line delay processing is changed depending on the value of the printing direction signal a. In the case of printing from the left hand side to the right hand side, that is, the printing direction signal a=H, the line 112 concerning the odd-side data FO is positioned behind the line 114 concerning the even-side data FE along the printing direction. On the other hand, in the case of printing from the right hand side to the left hand side, that is, the printing direction signal a=L, the line 112 concerning the odd-side data FO is positioned in front of the line 114 concerning the even-side data FE along the printing direction. As described above, which data FO or FE should be set to the new data is determined depending on the printing direction, that is, the value of the printing direction signal a. The target selection processing for the 8 lines delay processing depending on the value of the printing direction signal a in the odd-even separator 86 is used for adapting the printing control to such an ahead and behind relation.

In the odd-side delay & multiplexer 88-0, the odd-side data FO selectively delayed depending on the interval between the straight lines and the printing direction are latched at the timing of the odd-side clock G1 in the shift registers 102-OH and 102-OL. By this operation, the odd number nozzle data FOH and FOL shown by white dots on the broken line 112 or 114 are produced from the odd-side data FO.

Similarly, in the even-side delay & multiplexer 88-E, the even-side data FE selectively delayed depending on the interval between the straight lines and the printing direction are latched at the timing of the even-side clock G2 in the shift registers 102-EH and 102-EL. By this operation, the even number nozzle data FEH and FEL shown by black dots on the broken lines 112 and 114 are produced from the even-side data FE.

In the odd-side delay & multiplexer 88-0, further, the odd number nozzle data FOH and FOL are delayed in the shift registers 106-01 to 106-023. This operation delays the bit data depending on the positions of the dots 24 on a broken line 116. The broken line 116 corresponds to the straight line of the odd number nozzles 18 shown in FIG. 21.

Similarly, in the even-slide delay & multiplexer 88-E, the even number nozzle data FEH and FEL are delayed on the shift registers 106-El to 106-E23. This operation delays the bit data depending on the positions of the dots 24 on a broken line 118. The broken line 118 corresponds to the straight line of the even number nozzles 18 shown in FIG. 21.

For example, the first dot 24 positioned on the broken line 116 corresponds to the first nozzle 18 in FIG. 21, and the third dot 24 positioned on the broken line 116 corresponds to the third nozzle 18 in FIG. 21. The first nozzle 18 and the third nozzle 18 are arranged on the same straight line, as shown in FIG. 21, and the printing direction interval of these nozzles 18 is equivalent to 4 dots. Hence, the bit data to be used for the ink discharge control (output) by the first nozzle 18 at a certain printing timing must be data at a timing with 4 dots difference with respect to the bit data to be used for the ink discharge control (output) by the third nozzle 18. In the case of the printing direction signal a=H, that is, the printing direction is from the left hand side to the right hand side, the former must be older data than the latter, and in the case of the printing direction signal a=L, that is the printing direction is from the right hand side to the left hand side, the former must be newer data than the latter. The shift registers 106-01 and 106-El perform this timing control processing, that is, the 4 bits-per-one-interval delay processing depending on the positions of the nozzles 18 on the same straight line. The other shift registers 106-02 to 106-023 and 106-E2 to 106-E23 carry out the similar processing.

Also, in the odd-side delay & multiplexer 88-0 and the even-side delay & multiplexer 88-E, there are provided the two shift registers 102-OH and 102-OL as a shift register 102-0 and the two shift registers 102-EH and 102-EL as a shift register 102-E, and further the multiplexers 104-01 to 104-024 and 104-El to 104-E24 for selecting these outputs and the up/down counters 110-0 and 110-E are provided so as to cope with the change of the positional relationship (ahead or behind of the printing direction) between the nozzles 18 arranged on the same straight line depending on the printing direction.

For example, the third nozzle 18 is positioned either behind or in front of the first nozzle 18 when the printing direction signal a is H or L. In this embodiment, depending on H or L of the printing direction signal a, the different bit order of odd number nozzle data are selected and are delayed corresponding to the positions of the nozzles 18 arranged on the same straight line by the shift registers 106-01 to 106-023. The formation of the different bit order of odd number nozzle data is executed by the shift registers 102-0H and 102-OL, and their selections are carried out by the multiplexers 104-01 to 104-024. Further, the obtained odd number nozzle data are multiplexed in order depending on the printing direction, and the obtained odd-nozzle data FOm are output to the odd-side output circuit 90-0 in order of the numbers attached to the nozzles 18 shown in FIG. 21. Also, on the even-side, the operation is carried out in the same manner as described above in the even-side delay & multiplexer 88-E.

As described above, the odd-side delay & multiplexer 88-0 and the even-side delay & multiplexer 88-E form the data suitable for the head of the inclined zig zag arrangement shown in FIG. 21 by using the odd-side data FO and the even-side data FE output from the odd-even separator 86.

Figure 29:
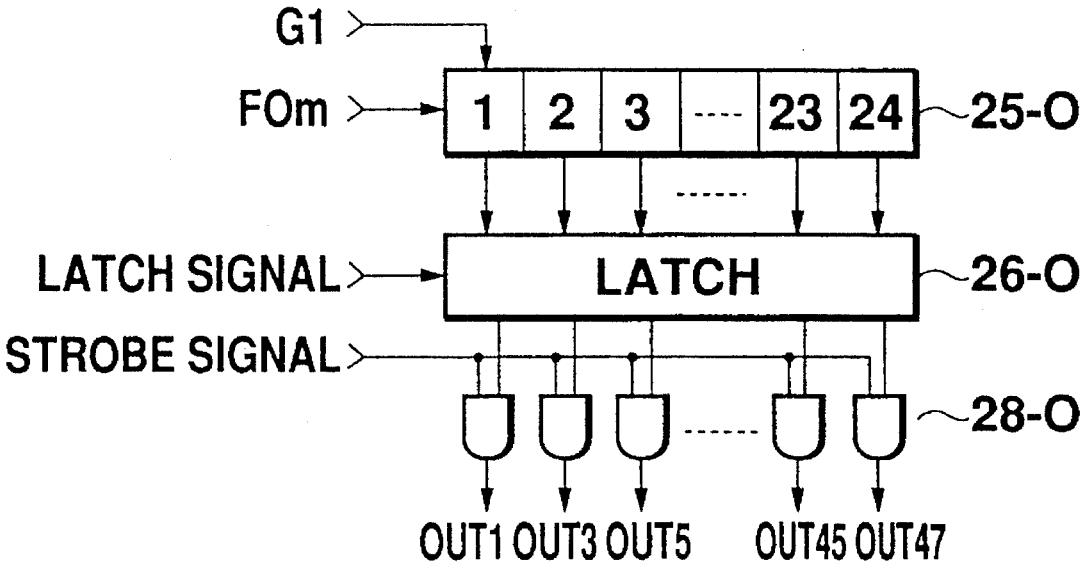
FIG. 29 is a block diagram of an odd-side output circuit shown in FIG. 22.
Figure 30:
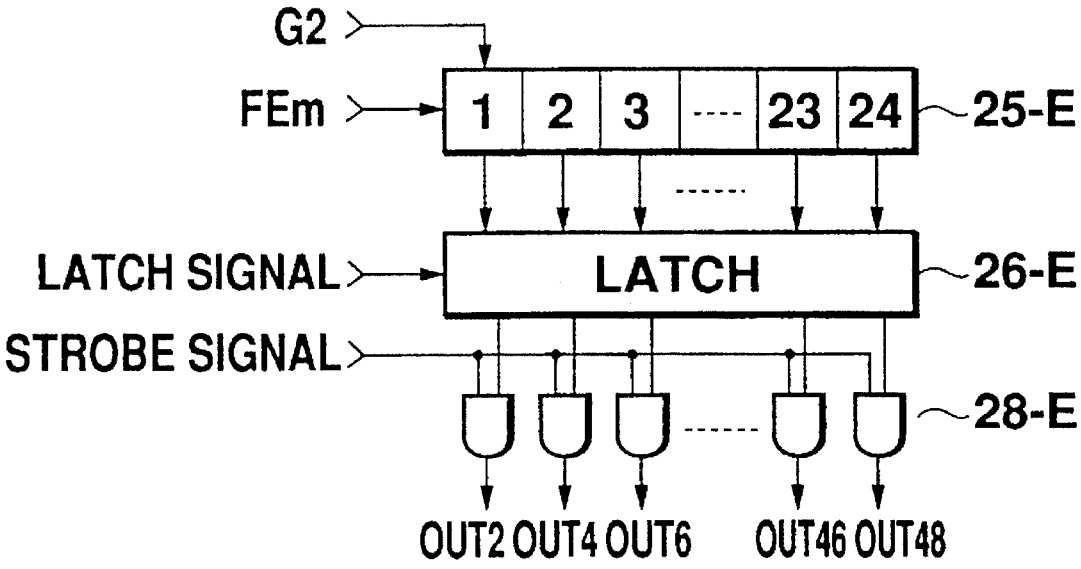
FIG. 30 is a block diagram of an even-side output circuit shown in FIG. 22.

In FIGS. 29 and 30, there are shown the odd-side output circuit 90-0 and the even-side output circuit 90-E. As shown in FIGS. 29 and 30, the constructions of the odd-side output circuit 90-0 and the even-side output circuit 90-E are the same as the driver circuit for one vertical arrangement of the nozzles as shown in FIG. 35, except that the output bit number of each circuit is 48/2=24 bits because of the two arrangements of the nozzles 18. In this embodiment, the odd-side output circuit 90-0 is comprised of a 24 bits of shift register 25-0, a 24 bits of latch 26-0 and 24 ANDs 28-0. Similarly, the even-side output circuit 90-E is comprised of 24 bits of shift register 25-E, 24 bits of latch 26-E and 24 ANDs 28-E. To the odd-side output circuit 90-0, the odd-side clock G1 and the odd-nozzle data FOm are input, and the odd-side output circuit 90-0 outputs 24 odd number OUT1, OUT3, . . . and OUT47. To the even-side output circuit 90-E, the even-side clock G2 and even-nozzle data FEm are input, and the even-side output circuit 90-E outputs 24 even number OUT2, OUT4, . . . and OUT48.

Figure 31:
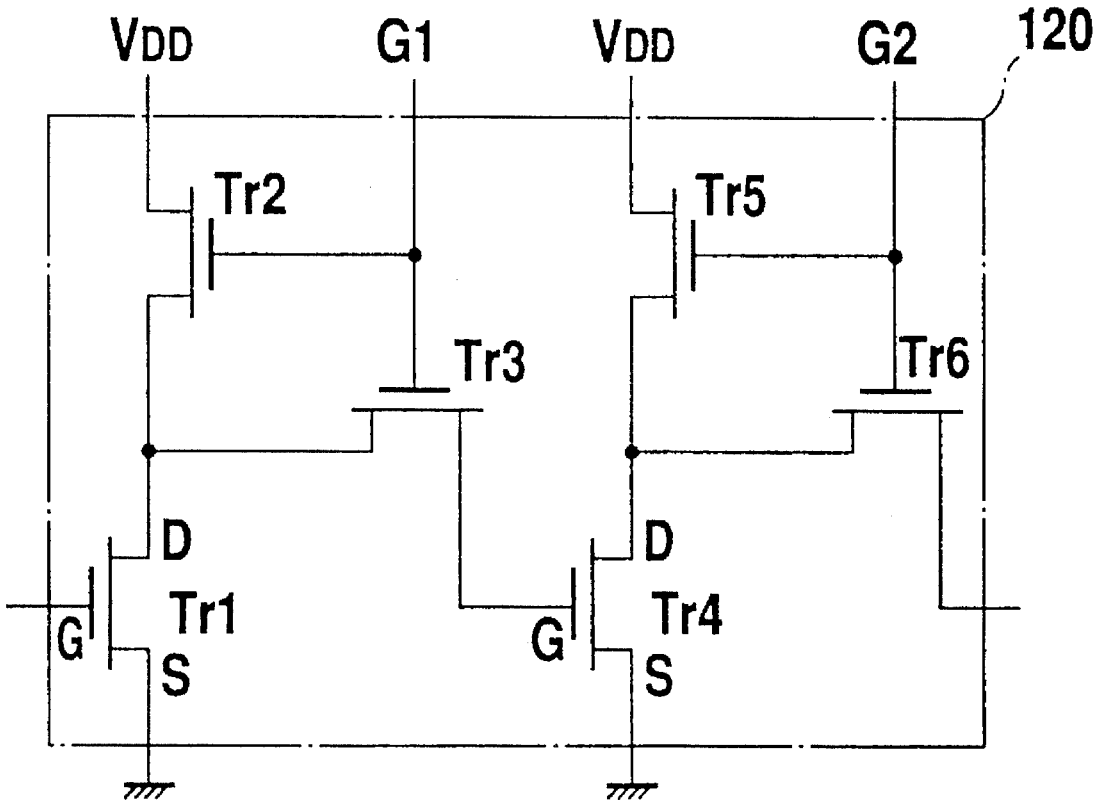
FIG. 31 is a circuit diagram of shift registers shown in FIGS. 26 and 27.

In FIG. 31, there is shown one embodiment of a circuit to be used for the shift registers 106-01 to 106-023 or 106-E1 to 106-E23. The circuit 120 is a circuit for one bit shift, and thus depending on a shift bit number, a plurality of circuits 120 can be connected in cascade so as to obtain a shift register of the desired bit number.

The circuit 120 is comprised of six transistors Tr1 to Tr6. The bit data to be shifted are applied as a voltage to the gate (G) of the transistor Tr1, and the electric charge is stored in the capacitance between the gate (G) and the source (S) of the transistor Tr1. When the clock G1 is changed to H, the transistor Tr1 acts as an inverter, and, when the gate (G) voltage is high or low, a drain (D) voltage becomes low or high respectively. In the case of the high drain (D) voltage, by this voltage, the electric charge is stored in the capacitance between the gate (G) and the source (S) of the transistor Tr4. The transistor Tr4 operates in the same manner as the transistor Tr1 by the clock G2 having the opposite phase to that of the clock G1. Hence, in this circuit construction, the shifting of the bit data can be performed and the high speed operation can be carried out because of the serial connection of the dynamic gates.

In this embodiment, further, the shift registers 106-01 to 106-023 and 106-El to 106-E 23 can be constructed by using a RAM. That is, a plurality of RAMs are connected in cascade so that 4 bits of data may be transferred from the front stage to the rear stage and store the data therein. This can be suitably used for processing the delay per 4 bit units in this embodiment. When the shift register is constructed by using the RAMs, the data transfer is executed by using the flip-flop or the like, and it is sufficient to use a certain cycle of the clock as a write enable of the RAMs.

As described above, in this embodiment, the input serial data are separated into the odd-side serial data FO and the even-side serial data FE, and the serial data FO and FE are delayed depending on the positions of the nozzles 18 arranged in the inclined zig zag arrangement in the head and the printing direction signal a. Hence, by inputting the data and the like similar to the case of the vertical arrangement of the nozzles 18, the printing can be executed without preprocessing the order operation or the like. As a result, the usability can be improved. Further, in particular, by constructing using the IC, the circuit structure of the ink jet printer can be simplified, and thus a reduction of substrate occupied area and low cost can be realized.

Further, the delay amount setting depending on the interval between the nozzle arrangements and the interval between the nozzles 18 arranged on the same straight line is switched depending on the printing direction signal a, and with this operation, the orders of the serial/parallel conversion by the shift registers are switched by the switching of the multiplexing direction. Hence, the printing control depending on the printing direction can be carried out. Also, since the two-phase clocks G1 and G2 for executing the odd-even separation can be generated by a simple circuit as shown in FIG. 23, it is sufficient to use a clock similar to a conventional clock as the original clock G. Further, since the operations such as the delay, the multiplexing, the serial/parallel conversion and the output are executed by the circuit structure of two systems such as odd and even sides, the circuit construction can be separated into units and thus can be simplified.

Further, this embodiment can be combined with any of the fifth to eighth embodiments. Also, as described above, the sixth to eighth embodiments can be combined with the second embodiment. When the second embodiment is combined with any of the sixth to eighth embodiments and the tenth embodiment, since the nozzles are classified into a plurality of groups, it is required to modify some parts such as providing a plurality of circuits shown in FIG. 22 and the like according to the nozzle grouping, but such modifications are apparent for those skilled in the art.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A head for ink jet printing comprising:

a substrate;

a plurality of nozzles arranged on a flat surface of the substrate for discharging ink, the nozzles being arranged in a zig zag arrangement wherein the nozzles are arranged in only first and second straight lines on the flat surface, and wherein the nozzles arranged in the first straight line are offset with respect to the nozzles arranged in the second straight line along a direction perpendicular to a printing direction; and path means formed in the substrate for supplying the ink to the nozzles, the path means including:

a plurality of pressure chambers formed in the substrate, and a plurality of ink slits, having a substantially narrower width than the pressure chambers, formed in the substrate and arranged radially, each ink slit fluidly coupling one of the pressure chambers to one of the nozzles, wherein the ink slits have lengths that are similar so that a viscous drag for ink passing through the ink slits is equalized among the ink slits;

wherein a depth of each ink slit is larger than a width of each ink slit at a location near the nozzles.

2. The head of claim 1, wherein the path means further includes:

an ink introducing mechanism for introducing the ink into the pressure chambers;

and discharge means for discharging ink and including a plurality of pressing elements attached on the substrate at location corresponding to the pressure chambers for applying a pressure to a corresponding pressure chamber in response to a command, wherein the pressing element receives the command and applies the pressure to the corresponding pressure chamber the ink within the corresponding pressure chamber to be fed to the corresponding ink slit, and the corresponding nozzle to discharge the ink, wherein when the command is released, almost the same amount of ink as the amount of ink fed to the corresponding ink slit is introduced into the corresponding pressure chamber by the ink introducing mechanism.

3. The head of claim 2, wherein the ink introducing mechanism includes:

an ink chamber formed to connect and surround the pressure chambers on the substrate; and an ink introducing aperture for introducing the ink into the ink chamber.

4. The head of claim 2, wherein the substrate is a photosensitive glass substrate, and the nozzles, the ink slits, the pressure chambers and the ink introducing mechanism are formed by an anisotropic etching of the substrate.

5. The head of claim 4, wherein the nozzles are formed by the anisotropic etching including a step of exposing while the substrate is rotated and inclined.

6. The head of claim 2, wherein the nozzles are separately arranged in a plurality of groups near a central point of either a circle or a circular arc on the flat surface.

7. The head of claim 6, wherein a plurality of groups of the pressure chambers and the ink slits corresponding to the plurality of groups of nozzles constitute a plurality of ink paths mutually separated.

8. The head of claim 6, wherein the separation groups of the nozzles are three.

9. The head of claim 7, wherein different color inks are supplied to the respective ink paths.

10. The head of claim 2, wherein the pressing elements are piezoelectric elements that are excited and distorted by the command supplied as a voltage.

11. The head of claim 10, wherein the discharge means includes a vibrating member to be vibrated by the distortion of the piezoelectric elements when the piezoelectric elements are excited.

12. The head of claim 2, wherein the discharge means includes the piezoelectric substrate in a circular arc, the piezoelectric substrate having a common electrode on one surface and a plurality of individual electrodes corresponding to the pressure chambers on another surface, and wherein each pressing element is a piezoelectric element composed of the piezoelectric substrate, each individual electrode and the common electrode.

13. The head of claim 12, wherein the piezoelectric substrate includes concav surfaces for electrically and acoustically separating the adjacent individual electrodes.

14. The head of claim 12, wherein the piezoelectric substrate is arranged so that the individual electrodes mounted on another surface of the piezoelectric substrate face the opposite side to the pressure chambers.

15. The head of claim 1, wherein each nozzle posesses a substantially circular opening.

16. The head of claim 1, wherein there is a plurality of separated groups of nozzles arranged in the zig zag arrangement, the groups being coupled to a respective ink source of a different color.

* * * * *